US011726428B2

(12) United States Patent
Yamada

(10) Patent No.: US 11,726,428 B2
(45) Date of Patent: Aug. 15, 2023

(54) IMAGE FORMING APPARATUS WITH IMPROVED OPERABIITY FOR ATTACHING AND DETACHING A CARTRIDGE

(71) Applicant: CANON KABUSHIKI KAISHA, Tokyo (JP)

(72) Inventor: Jiro Yamada, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/589,976

(22) Filed: Feb. 1, 2022

(65) Prior Publication Data

US 2022/0253015 A1 Aug. 11, 2022

(30) Foreign Application Priority Data

Feb. 5, 2021 (JP) ..... 2021-017006

(51) Int. Cl.
*G03G 21/18* (2006.01)

(52) U.S. Cl.
CPC ... *G03G 21/185* (2013.01); *G03G 2221/1684* (2013.01)

(58) Field of Classification Search
CPC ..... G03G 21/185; G03G 2221/1684; G03G 21/1633; G03G 21/16; G03G 21/1842
See application file for complete search history.

(56) References Cited

U.S. PATENT DOCUMENTS 8,280,279 B2 10/2012 Mizuno
2009/0290903 A1* 11/2009 Horikawa ..... G03G 21/185 399/111
2018/0120765 A1* 5/2018 Seto ..... G03G 21/1633
2020/0174419 A1* 6/2020 Murasaki ..... G03G 21/185

FOREIGN PATENT DOCUMENTS

JP 2009282397 A 12/2009
JP 2010164993 A 7/2010

* cited by examiner

*Primary Examiner* — Sandra Brase
(74) *Attorney, Agent, or Firm* — Rossi, Kimms & McDowell LLP

(57) ABSTRACT

An image forming apparatus includes an apparatus body, an opening/closing member, a cartridge configured to be inserted into and pulled out from the apparatus body, a supporting member configured to support the cartridge, a moving mechanism configured to support the supporting member and move the supporting member from a second position to a first position in accordance with a movement of the opening/closing member from an open position to a closed position, and an urging member configured to urge the supporting member or the moving mechanism so that the supporting member is retained at the second position by the moving mechanism in a state where the opening/closing member is in the open position.

12 Claims, 10 Drawing Sheets

IMAGE FORMING APPARATUS WITH IMPROVED OPERABIITY FOR ATTACHING AND DETACHING A CARTRIDGE

BACKGROUND OF THE INVENTION

Field of the Invention

The present disclosure relates to an image forming apparatus that forms images on recording materials.

Description of the Related Art

In an electrophotographic image forming apparatus, one or more members for performing electrophotographic processes are disposed in a cartridge that can be detachably attached to an image forming apparatus body (hereinafter referred to as an apparatus body), for making it easier to perform replacement work. Such a cartridge is positioned at a position appropriate for performing image forming operations, in a state where the cartridge is attached to the apparatus body. In Japanese Patent Application Publication Nos. 2010-164993 and 2009-282397, in a state where an opening/closing member that can be opened and closed with respect to an apparatus body is opened, a cartridge is inserted into the apparatus body through an opening portion of the apparatus body, and supported by a supporting member. Then the supporting member is lifted in accordance with the closing operation of the opening/closing member, so that the cartridge is positioned.

However, in the configuration described in Japanese Patent Application Publication Nos. 2010-164993 and 2009-282397, it is desired to improve the positional accuracy of the supporting member in a state where the opening/closing member is opened. If the positional accuracy of the supporting member is high in the state where the opening/closing member is opened, the cartridge that is attached to and detached from the apparatus body along the supporting member will hardly interfere with a member disposed around the opening portion of the apparatus body. As a result, the operability for attaching and detaching the cartridge can be increased.

SUMMARY OF THE INVENTION

The present invention provides an image forming apparatus capable of improving operability for attaching and detaching a cartridge.

According to one aspect of the invention, an image forming apparatus includes an apparatus body, an opening/closing member configured to move between a closed position in which the opening/closing member closes an opening portion provided in the apparatus body and an open position in which the opening/closing member opens the opening portion, a cartridge configured to be inserted into and pulled out from the apparatus body through the opening portion in a state where the opening/closing member is in the open position, a supporting member configured to support the cartridge inserted into the apparatus body, the supporting member being configured to guide the cartridge while the cartridge is inserted into and pulled out from the apparatus body, a moving mechanism configured to support the supporting member and move the supporting member from a second position to a first position in accordance with a movement of the opening/closing member from the open position to the closed position, the first position being a position in which the cartridge is allowed to be used for performing an image forming operation, the second position being a position in which the cartridge is allowed to be inserted into and be pulled out from the apparatus body, and an urging member configured to urge the supporting member or the moving mechanism so that the supporting member is retained at the second position by the moving mechanism in a state where the opening/closing member is in the open position.

Further features of the present invention will become apparent from the following description of exemplary embodiments with reference to the attached drawings.

DESCRIPTION OF THE EMBODIMENTS

Hereinafter, some embodiments of the present disclosure will be described with reference to the accompanying drawings.

In the following description, an image forming apparatus and its components will be described in arrangement and size, with reference to three directions: X, Y, and Z. The X, Y, and Z directions are common to the image forming apparatus and the components, and intersect each other. The Z direction is a vertical direction (gravity direction) of the image forming apparatus placed on a horizontal plane. The Y direction is a rotation-axis direction of an image bearing member (referred to also as a photoreceptor in electrophotography), and is a main scanning direction in the image formation. The X direction is a direction that intersects the Y direction and the Z direction. Preferably, the X direction, the Y direction, and the Z direction are orthogonal to each other. Thus, the X direction and the Y direction are preferably horizontal directions that are orthogonal to the Z direction. In the below-described drawings, the X direction, the Y direction, and the Z direction are orthogonal to each other. In addition, when a direction is expressed with a "+" sign, the direction is indicated by a corresponding arrow in each drawing; when a direction is expressed with a "−" sign, the direction is opposite to a direction indicated by a corresponding arrow. In addition, as to a component that is detachably attached to the apparatus body of the image forming apparatus, the description will be made for the position and posture of the component in a state where the component is incorporated in the apparatus body.

First Embodiment

Figure 1:
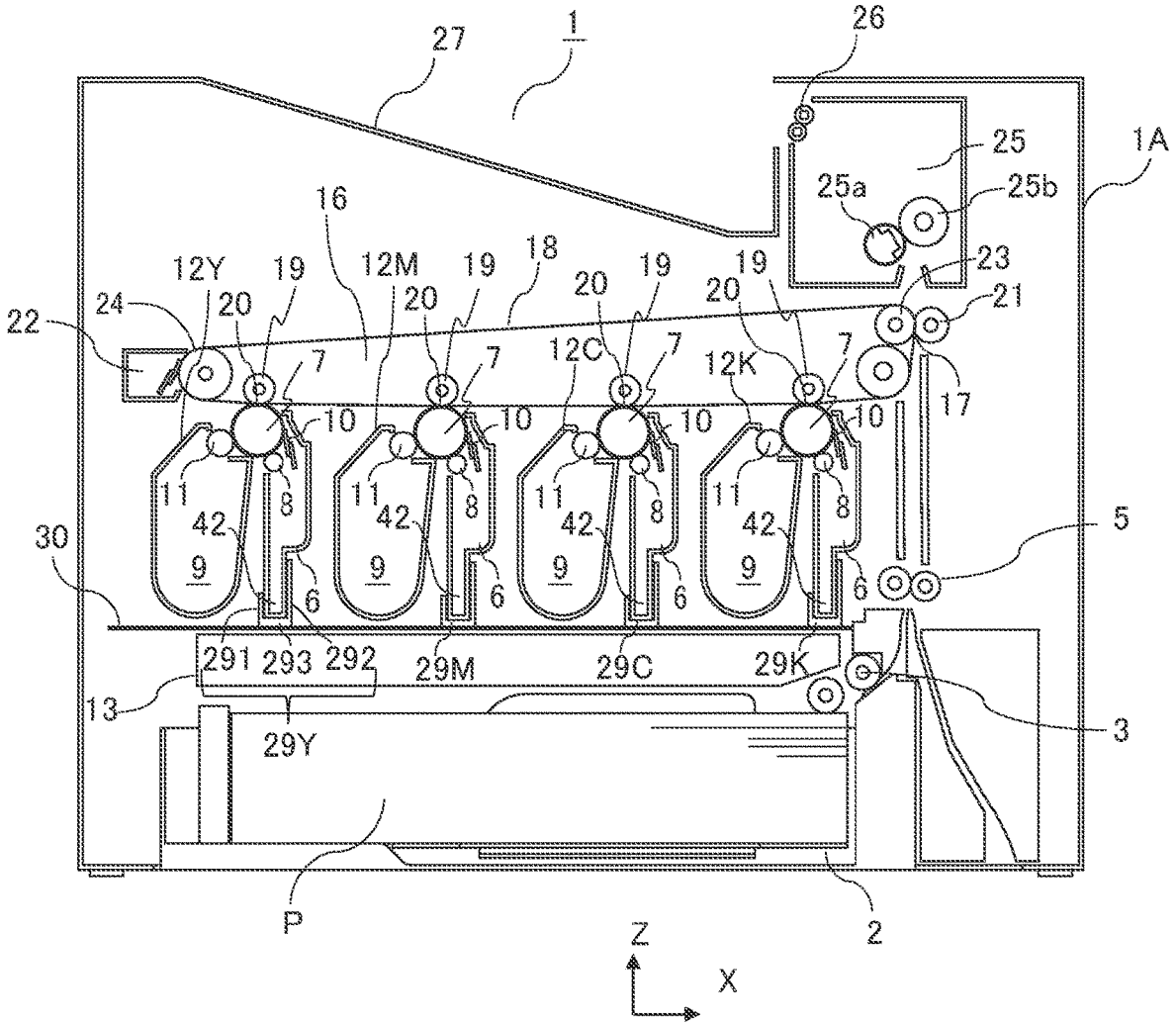
FIG. 1 is a cross-sectional view of an image forming apparatus of a first embodiment.
Figure 2A:
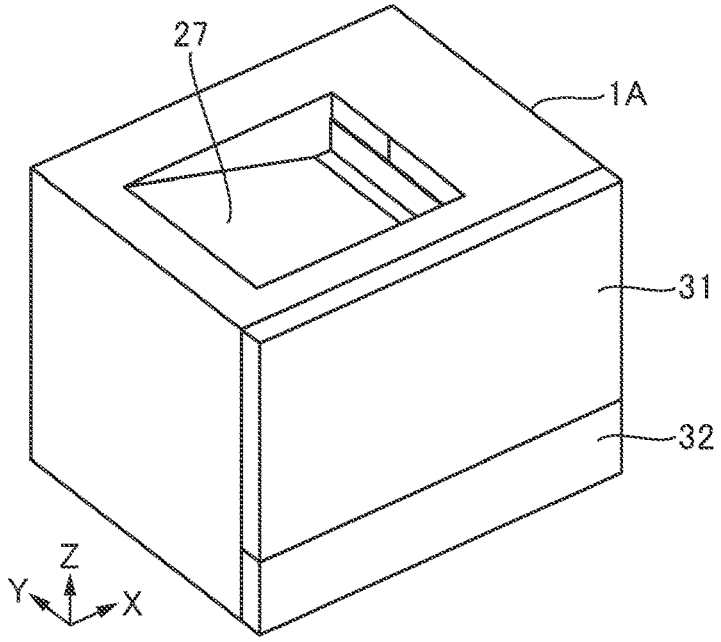
FIG. 2A is a perspective view illustrating an external appearance of the image forming apparatus of the first embodiment.
Figure 2B:
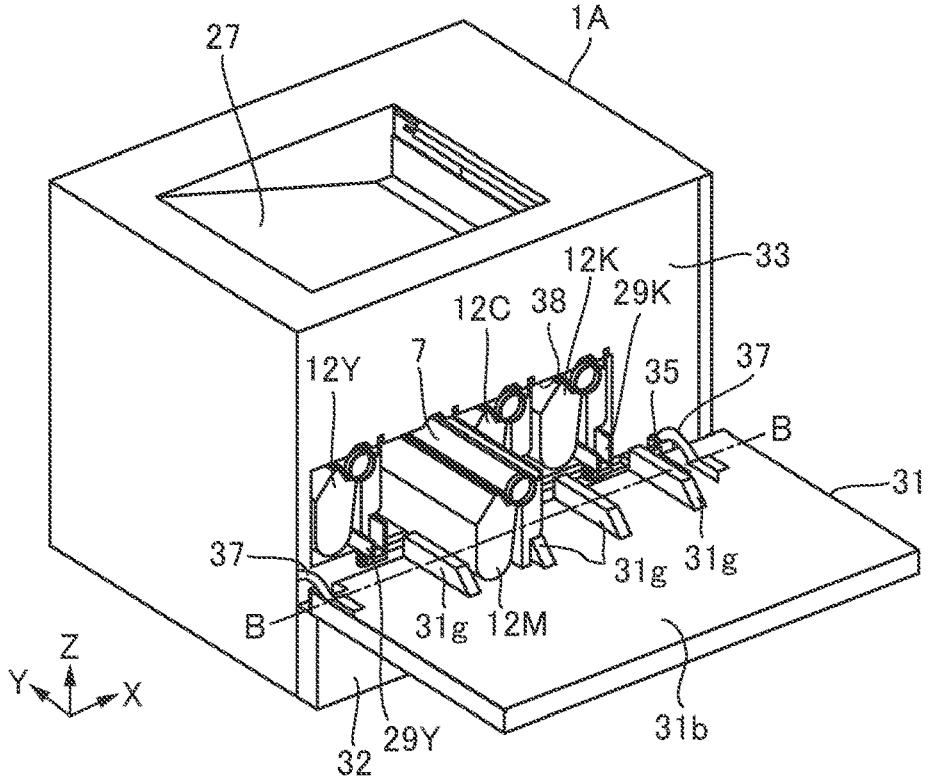
FIG. 2B is a perspective view illustrating an external appearance of the image forming apparatus of the first embodiment.

FIG. 1 is a cross-sectional view of an image forming apparatus 1 of a first embodiment, and illustrates a cross section of the image forming apparatus 1 that is perpendicular to the Y direction. The cross-sectional view illustrates the overall configuration of the image forming apparatus 1. FIGS. 2A and 2B are perspective views illustrating an external appearance of the image forming apparatus 1. FIG. 2A illustrates a state where a front door 31 is closed. FIG. 2B illustrates a state where the front door 31 is opened and a cartridge 12M is being inserted into (or drawn from) an apparatus body 1A of the image forming apparatus 1.

As illustrated in FIG. 1, the image forming apparatus 1 includes an intermediate-transfer tandem electrophotographic mechanism that serves as an image forming portion. The electrophotographic mechanism includes an intermediate transfer unit 16 and four process cartridges (hereinafter referred to as cartridges) 12Y, 12M, 12C, and 12K. The intermediate transfer unit 16 includes an intermediate transfer belt 18 that serves as an intermediate transfer member, and the four cartridges are disposed along the intermediate transfer belt 18. The electrophotographic mechanism also includes a scanner unit 13 that serves as an exposing portion, a secondary transfer roller 21 that serves as a transfer portion, and a fixing apparatus 25 that serves as a fixing portion. The image forming apparatus 1 has an image forming function (printing function) that forms an image on a recording material P in accordance with image data and an instruction to execute the image forming operation. The image data and the instruction are sent from an external device.

A cassette 2 is housed in a lower portion of the image forming apparatus 1. The cassette 2 stores the recording material P, and can be drawn from the apparatus body 1A. In the vicinity of an edge portion of the cassette 2 in the X direction, a feeding unit 3 is disposed for feeding the recording material P stacked and stored in the cassette 2. Specifically, the feeding unit 3 separates a recording material P from the others, one by one, and feeds the recording material P. The recording material P fed by the feeding unit 3 is conveyed toward a registration roller pair 5.

The recording material P may be a paper sheet, such as a plain paper sheet or a thick paper sheet, a plastic film, a cloth sheet, a sheet material, such as a coated paper sheet, on which certain surface treatment has been performed, a specially-shaped sheet material, such as an envelope or an index paper sheet, or any one of a variety of sheets having different sizes and materials. The apparatus body 1A is a portion of the image forming apparatus 1, other than the detachable units, such as the cassette 2 and the cartridges 12Y to 12K, the front door 31, cartridge supporting members 29Y to 29K, and a link unit 54. The front door 31, the cartridge supporting members 29Y to 29K, and the link unit 54 will be described later.

The cartridges 12Y, 12M, 12C, and 12K are image forming units (referred to also as process units) that form images (toner images) by using yellow, magenta, cyan, and black toners, respectively. When viewed in the Y direction, the four cartridges 12Y to 12K are disposed adjacent to each other, substantially in the X direction.

The four cartridges 12Y to 12K have substantially the same configuration, except for the color of toner contained in each cartridge. Each of the cartridges 12Y to 12K includes a photosensitive drum 7 that serves as an image bearing member, a cleaner unit 6, and a developing apparatus 9. The photosensitive drum 7 is a cylindrical member with a center axis extending in the Y direction, and has a photosensitive layer formed on the outer circumferential portion of the photosensitive drum 7 and made of a photoreceptor such as an organic photoreceptor. The cleaner unit 6 includes a charging apparatus 8 and a drum cleaner 10. The charging apparatus 8 may be a roller member that abuts against the photosensitive drum 7. When applied with a voltage, the charging apparatus 8 charges the surface of the photosensitive drum 7 through proximity discharge. The drum cleaner 10 includes a blade that abuts against the photosensitive drum 7. The blade serves as a cleaning member that removes foreign substance, such as transfer residual toner, from the photosensitive drum 7. The developing apparatus 9 stores developer that contains toner with a color of yellow, magenta, cyan, or black. The developing apparatus 9 includes a developing roller 11 that serves as a developer bearing member, which bears the developer and supplies the developer onto the photosensitive drum 7.

The scanner unit 13 is disposed below the cartridges 12Y to 12K. The scanner unit 13 includes a laser beam source, and an optical system such as a polygon mirror. The polygon mirror receives a laser beam emitted from the laser beam source, and emits the laser beam toward the photosensitive drum 7. In addition, the polygon mirror scans the photosensitive drum 7 with the laser beam in the Y direction.

The intermediate transfer unit 16 is disposed above the cartridges 12Y to 12K, and can be detachably attached to the apparatus body 1A. The intermediate transfer unit 16 includes the intermediate transfer belt 18, a secondary transfer inner roller 23, a stretching roller 24, primary transfer rollers 19, and a belt cleaner 22. Each of the primary transfer rollers 19 is disposed, associated with a corresponding photosensitive drum 7. The intermediate transfer belt 18 is stretched by the secondary transfer inner roller 23 and the stretching roller 24, which are disposed separated from each other; and extends substantially in the X direction. The intermediate transfer belt 18 is a rotatable endless belt. Each of the primary transfer rollers 19 is disposed in contact with the inner surface of the intermediate transfer belt 18. Thus, a primary transfer portion 20 is formed between a primary transfer roller 19 and a corresponding photosensitive drum 7, which is in contact with the outer surface of the intermediate transfer belt 18. Each primary transfer roller 19 is a primary transfer member that transfers a toner image from the photosensitive drum 7 onto the intermediate transfer belt 18 when applied with a voltage. The belt cleaner 22 includes a blade that is in contact with the intermediate transfer belt 18. The blade serves as a cleaning member that removes foreign substance, such as transfer residual toner, from the intermediate transfer belt 18.

The secondary transfer roller 21 is disposed in contact with the outer surface of the intermediate transfer belt 18. Thus, a secondary transfer portion 17 is formed between the secondary transfer roller 21 and the secondary transfer inner roller 23, which is in contact with the inner surface of the intermediate transfer belt 18. The secondary transfer roller 21 is a secondary transfer member that transfers a toner image from the intermediate transfer belt 18 onto the recording material P when applied with a voltage.

The fixing apparatus 25 includes a heating unit 25*a* that conveys the recording material P while heating the recording material P, and a pressing roller 25*b* that is in pressure contact with the heating unit 25*a*. For example, the heating unit 25*a* is a heater unit disposed on the inner-surface side of an endless belt and including a resistor that generates heat when supplied with current that flows through the resistor. The fixing apparatus 25 applies heat and pressure to an image formed on the recording material P, while conveying the recording material P through the nip portion formed between the heating unit 25*a* and the pressing roller 25*b* in a state where the recording material P is nipped by the heating unit 25*a* and the pressing roller 25*b*. A discharging roller pair 26 is disposed as a discharging unit, on the downstream side of the fixing apparatus 25. In addition, a discharging tray 27 is disposed on the top surface of the apparatus body 1A, as a stacking portion on which the recording material P having been discharged by the discharging roller pair 26 is stacked.

Note that a low-voltage power supply is disposed on the back-surface side in the apparatus body 1A (i.e., on the back side of FIG. 1 in the Y direction, or on a side opposite to the front door 31 in FIGS. 2A and 2B) for supplying voltages to driving circuits used for a motor, a fan, a solenoid, and the like, which are disposed in the image forming apparatus 1. In addition, a high-voltage power supply is disposed in the apparatus body 1A, in a space above the intermediate transfer unit 16, for supplying high voltages to the charging apparatus 8, the developing apparatus 9, the primary transfer rollers 19, the secondary transfer roller 21, and the like. In addition, a control board is mounted in the apparatus body 1A, as a control unit that controls the power supplies and the whole of operations of the image forming apparatus 1.

Image Forming Operation

Next, a flow of image forming operations performed by the image forming apparatus 1 will be described. First, the photosensitive drum 7 of each of the cartridges 12Y to 12K and the intermediate transfer belt 18 are rotated, and the surface of the photosensitive drum 7 is uniformly charged by the charging apparatus 8. The scanner unit 13 irradiates the photosensitive drum 7 with a laser beam, which is modulated in accordance with image data to be formed as an image (printed image), and thereby forms an electrostatic latent image on the surface of the photosensitive drum 7. Electrostatic latent images formed on the photosensitive drums 7 are developed (visualized) into toner images with four colors, by using the developer supplied by the developing apparatus 9.

A toner image borne by a photosensitive drum 7 is transferred (primary-transferred) from the photosensitive drum 7 onto the intermediate transfer belt 18 in the primary transfer portion 20. Specifically, the transfer is performed such that a toner image to be transferred in a primary transfer portion 20 located downstream in the moving direction (i.e., right direction in FIG. 1) of the intermediate transfer belt 18 overlaps with a toner image having been transferred in a primary transfer portion 20 located upstream in the moving direction. As a result, a full-color image is formed on the intermediate transfer belt 18. Sticking substance, such as transfer residual toner, that has not been transferred onto the intermediate transfer belt 18 in the primary transfer portion 20 and is left on the photosensitive drum 7 is collected by the drum cleaner 10 of each of the cartridges 12Y to 12K.

In parallel with the above-described image forming process, the recording material P is fed from the cassette 2. The registration roller pair 5 conveys the recording material P in synchronization with the image forming process so that the recording material P reaches the secondary transfer portion 17 at the same time as the time when the image borne by the intermediate transfer belt 18 reaches the secondary transfer portion 17. Then, in the secondary transfer portion 17, the image is transferred (secondary-transferred) from the intermediate transfer belt 18 onto the recording material P. Sticking substance, such as transfer residual toner, that has not been transferred onto the recording material P in the secondary transfer portion 17 and is left on the intermediate transfer belt 18 is removed by the belt cleaner 22 and collected in a collection container (not illustrated).

The recording material P having passed through the secondary transfer portion 17 is heated and pressed in the fixing apparatus 25. In this operation, the toners with respective colors are melted and mixed with each other, and then cooled and solidified, so that the image is fixed to the recording material P. The recording material P having passed through the fixing apparatus 25 is discharged to the outside of the apparatus body 1A by the discharging roller pair 26, and stacked on the discharging tray 27.

Front Door

As illustrated in FIGS. 2A and 2B, the image forming apparatus 1 includes the front door 31 (referred to also as a door member or a cover member) that serves as an opening/closing member that can be opened and closed with respect to the apparatus body 1A. The front door 31 is disposed on a side surface of the apparatus body 1A, located in the −Y direction. The front door 31 can move between a position (closed position) illustrated in FIG. 2A and a position (open position) illustrated in FIG. 2B. That is, the state of the front door 31 is switched between a close state illustrated in FIG. 2A and an open state illustrated in FIG. 2B, by a user operation.

Hereinafter, the state where the front door 31 is located at the open position (i.e., the state where the front door 31 is opened with respect to the apparatus body 1A) is defined as a door open state, and the state where the front door 31 is located at the closed position (i.e., the state where the front door 31 is closed with respect to the apparatus body 1A) is defined as a door close state. In addition, the side of the image forming apparatus 1 on which the front door 31 is disposed (i.e., the side of the image forming apparatus 1 in the −Y direction) is defined as a front side, and the side of the image forming apparatus 1 opposite to the front side (front side) is defined as a back side.

As illustrated in FIG. 2B, in the present embodiment, hinge members 37 are disposed on both edge portions of a lower portion of the front door 31 in the X direction. Each of the hinge members 37 is pivotally supported by a hinge supporting member 35, which is disposed on a front-side frame 33 that constitutes the front-side portion of the frame of the apparatus body 1A. Thus, the front door 31 is supported by the apparatus body 1A, so as to be able to pivot on an axis B-B that extends in the X direction.

The front door 31 moves from the closed position (FIG. 2A) to the open position (FIG. 2B) when an upper edge portion of the front door 31 is pivoted downward and toward the front side of the image forming apparatus 1, and moves from the open position to the closed position when the upper edge portion of the front door 31 is pivoted toward the opposite direction. The front door 31 of the present embodiment can move between the closed position and the open position. The closed position is a position at which the front door 31 faces the front-side frame 33 that takes a substantially vertical posture when viewed in the X direction, and that is substantially perpendicular to the Y direction. The open position is a position to which the front door 31 is pivoted from the closed position by about 90°, and at which the front door 31 takes a substantially horizontal posture. Note that in the present embodiment, the cassette 2 can also be drawn out toward the front side of the image forming apparatus 1, by holding a holding portion (front panel) 32 disposed below the front door 31.

As illustrated in FIG. 2B, an opening portion 38 formed in the front-side frame 33 is disposed in a side portion of the apparatus body 1A in the −Y direction, and is opened toward the −Y direction. When the front door 31 is located at the closed position, the front door 31 covers the opening portion 38 in a state where the apparatus body 1A is viewed from the −Y direction. When the front door 31 is located at the open position, the front door 31 exposes the opening portion 38 in a state where the apparatus body 1A is viewed from the −Y direction, and allows the cartridges 12Y to 12K to be attached to or detached from the apparatus body 1A as described later.

Cartridge

Figure 3:
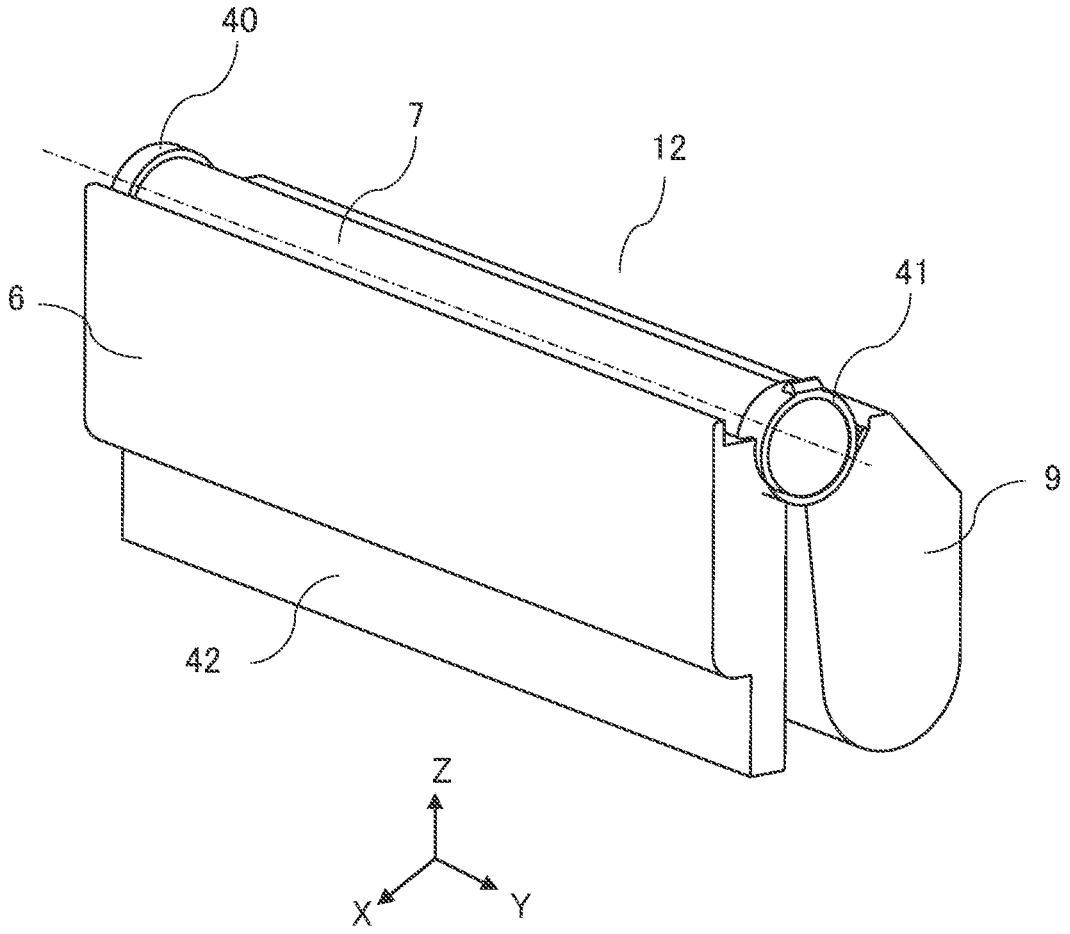
FIG. 3 is a perspective view illustrating an external appearance of a cartridge of the first embodiment.

FIG. 3 is a perspective view illustrating an external appearance of a cartridge 12, which can be used as the cartridge 12Y, 12M, 12C, or 12K of the image forming apparatus 1 of FIG. 1. The cartridge 12 is attached to the apparatus body 1A, as the cartridge 12Y, 12M, 12C, or 12K, in a state where the developing apparatus 9 contains developer with a proper color. Hereinafter, the cartridges 12Y, 12M, 12C, and 12K are referred to as the cartridge 12 if the cartridges need not to be distinguished from each other.

The cartridge 12 is an assembly (unit) whose longitudinal direction is equal to the rotation-axis direction (i.e., the direction of the axis illustrated as a broken line) of the photosensitive drum 7. The cartridges 12Y to 12K are attached to the image forming apparatus 1, with the posture in which the longitudinal direction of the cartridges is substantially equal to the Y direction.

Both end portions of the photosensitive drum 7 in the longitudinal direction are rotatably supported by a front-side bearing 40 and a back-side bearing 41. The front-side bearing 40 and the back-side bearing 41 are connected with the frame of the cleaner unit 6 and the frame of the developing apparatus 9. The frame of the cleaner unit 6 and the frame of the developing apparatus 9 extend in the longitudinal direction of the cartridge 12. The frame of the cleaner unit 6 and the frame of the developing apparatus 9 constitute the frame (housing) of the cartridge 12. In addition, one of the cleaner unit 6 and the developing apparatus 9 has a guided portion 42. In the present embodiment, the cleaner unit 6 has the guided portion 42 formed in a lower portion of the cleaner unit 6. The guided portion 42 is guided by a later-described cartridge supporting member 29 when the cartridge 12 is inserted into the apparatus body 1A, and is supported by the cartridge supporting member 29 after the cartridge 12 is inserted into the apparatus body 1A. That is, in a state where the cartridge 12 is inserted into the apparatus body 1A, at least one portion (i.e., the guided portion 42 in the present embodiment) of the bottom surface portion of the frame of the cartridge 12 is supported by the cartridge supporting member 29 from below in the gravity direction.

Attachment and Detachment of Cartridge

The cartridges 12Y to 12K attached to the image forming apparatus 1 are replaced with other cartridges when the toner of the developing apparatus 9 runs out, or when the service life of the photosensitive drum 7 is reached. As illustrated in FIG. 2B, when the cartridges 12Y to 12K are replaced with other cartridges, the opening portion 38 is exposed by opening the front door 31, which serves as an opening/closing member. When the opening portion 38 is exposed, the cartridges 12Y to 12K are moved as described later in accordance with the operation to open the front door 31, from a position at which the cartridges 12Y to 12K can perform image forming operations, to a position at which the cartridges 12Y to 12K can be removed from the apparatus body 1A. After that, a user can remove each of the cartridges 12Y to 12K from the apparatus body 1A, by holding the cartridge and pulling the cartridge out toward the front side (i.e., the −Y direction) of the image forming apparatus 1. When the cartridges 12Y to 12K are removed, the cartridges 12Y to 12K are pulled out along the longitudinal direction of the cartridges 12Y to 12K (i.e., the rotation-axis direction of the photosensitive drum 7).

FIG. 2B illustrates a state where the magenta cartridge 12M is being pulled out from the apparatus body 1A. Note that on an inner surface 31*b* (that is an upper surface at the open position) of the front door 31, guide ribs 31*g* are disposed, corresponding to the cartridges 12Y to 12K, for guiding the movement of the cartridges 12Y to 12K along the Y direction. The guide ribs 31*g* are rib-like projections, and project upward from the inner surface 31*b* of the front door 31 and extend in the Y direction in a state where the front door 31 is located at the open position.

When a user attaches the cartridges 12Y to 12K to the apparatus body 1A, the user opens the front door 31, and sets the longitudinal direction of the cartridges 12Y to 12K to the Y direction. Then the user inserts the cartridges 12Y to 12K from the front side of the image forming apparatus 1 into the interior of the apparatus body 1A through the opening portion 38, in the +Y direction that is an insertion direction. When the cartridges 12Y to 12K are inserted into the apparatus body 1A, the cartridges 12Y to 12K are guided by the guide ribs 31*g* of the front door 31 and the later-described cartridge supporting members 29, and are prevented from moving toward directions that intersect the +Y direction. After the cartridges 12Y to 12K are fully inserted into the apparatus body 1A, the user closes the front door 31 by pivoting the front door 31 upward. When the front door 31 is closed, the cartridges 12Y to 12K are moved, as described later, in accordance with the operation to close the front door 31, from the position at which the cartridges 12Y to 12K can be removed from the apparatus body 1A, to the position at which the cartridges 12Y to 12K can perform image forming operations.

Cartridge Supporting Member

In the apparatus body 1A, cartridge supporting members 29Y, 29M, 29C, and 29K are disposed as supporting members that respectively support (hold) the cartridges 12Y to 12K (FIG. 1). Hereinafter, the cartridge supporting members 29Y, 29M, 29C, and 29K are referred to as a cartridge supporting member 29 if the cartridge supporting members 29Y, 29M, 29C, and 29K need not to be distinguished from each other.

Figure 4A:
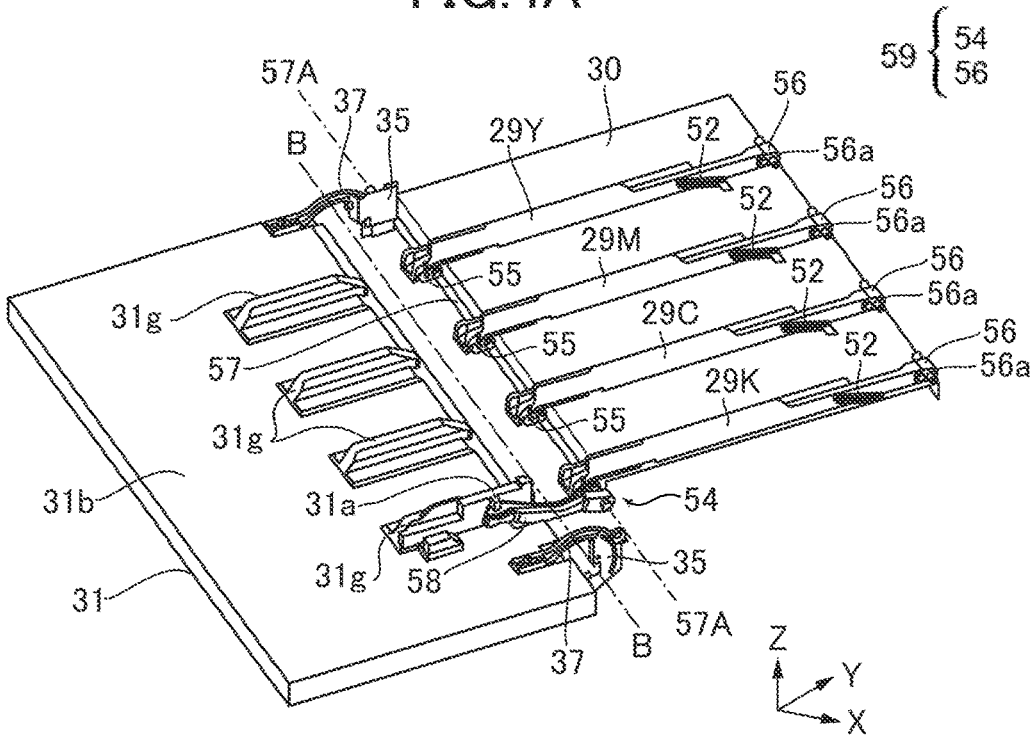
FIG. 4A is a perspective view illustrating a state of cartridge supporting members and other components of the first embodiment, obtained in a door open state.
Figure 4B:
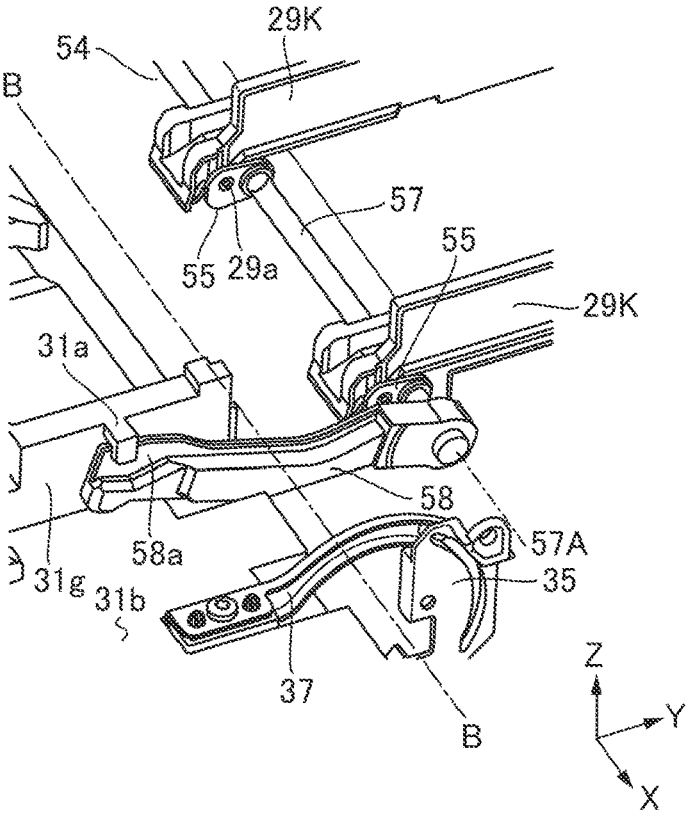
FIG. 4B is an enlarged view in which one portion of FIG. 4A is enlarged.
Figure 5A:
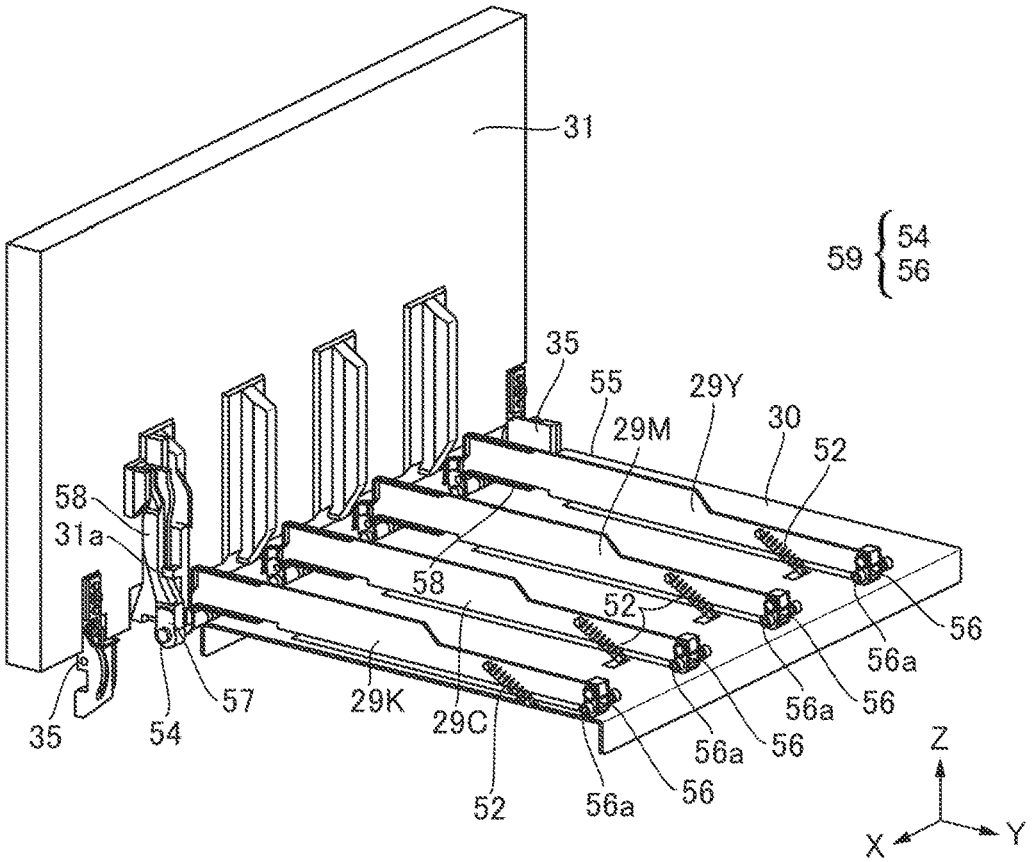
FIG. 5A is a perspective view illustrating a state of the cartridge supporting members and the other components of the first embodiment, obtained in a door close state.
Figure 5B:
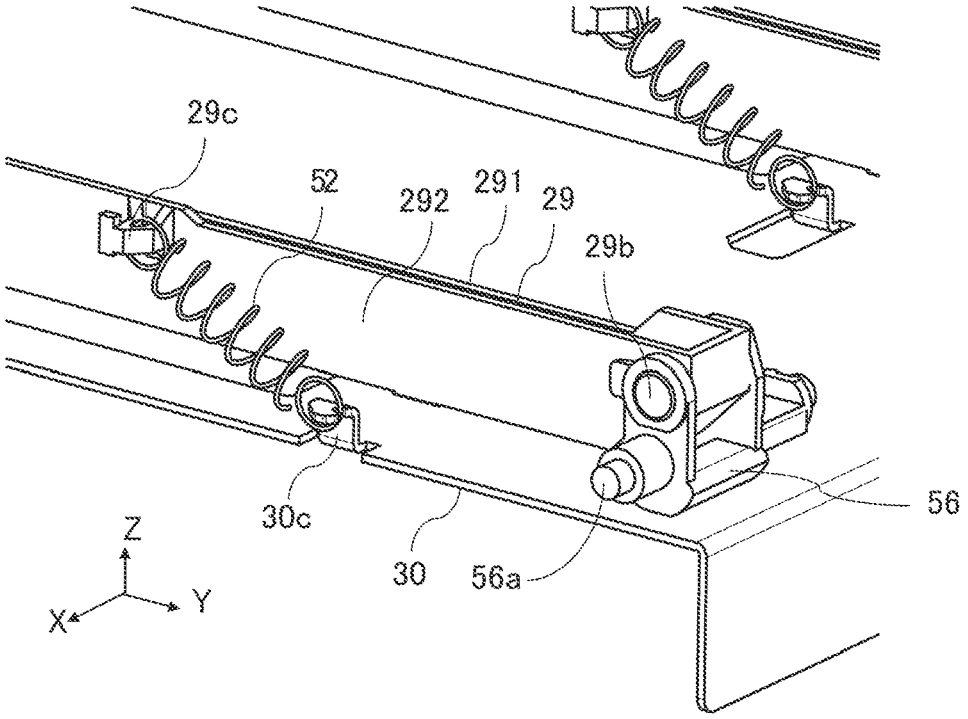
FIG. 5B is an enlarged view in which one portion of FIG. 5A is enlarged.

FIG. 4A is a perspective view illustrating the cartridge supporting members 29Y to 29K, the front door 31, and related components in a state where the front door 31 is opened. FIG. 4B is an enlarged view in which one portion of FIG. 4A is enlarged. FIG. 5A is a perspective view illustrating the cartridge supporting members 29Y to 29K, the front door 31, and the related components in a state where the front door 31 is closed. FIG. 5B is an enlarged view in which one portion of FIG. 5A is enlarged.

As illustrated in FIGS. 4A and 5A, the cartridge supporting member 29 extends in the Y direction, in which the cartridge 12 is attached to and detached from the apparatus body 1A. The cartridge supporting member 29 has a rectangular shape with one side open (i.e., U shape) that is opened upward when viewed in the Y direction. That is, the cartridge supporting member 29 includes a bottom portion 293, and side portions 291 and 292. The bottom portion 293 extends substantially in the horizontal direction (X direction) when viewed in the Y direction, and the side portions 291 and 292 extend upward (in the +Z direction) from both edge portions of the bottom portion 293, located in the X direction (see FIG. 1).

When the cartridge 12 is attached to and detached from the apparatus body 1A, the bottom portion 293 of the cartridge supporting member 29 faces the guided portion 42 of the cartridge 12 (FIG. 3) from below, and the side portions 291 and 292 of the cartridge supporting member 29 face the guided portion 42 from both sides in the X direction. That is, the cartridge 12 is guided by the cartridge supporting member 29 so that the guided portion 42 moves along a groove of the cartridge supporting member 29, which is defined by the bottom portion 293 and the side portions 291 and 292. Thus, the cartridge 12 is attached to and detached from the apparatus body 1A along the Y direction, and is prevented from moving toward directions that intersect the Y direction.

As illustrated in FIG. 1, in a state where the cartridge 12 is inserted into the apparatus body 1A, the cartridge 12 is supported by the cartridge supporting member 29 such that the guided portion 42 is held by the concave inner portion (recessed portion) of the cartridge supporting member 29. In particular, the bottom portion 293 of the cartridge supporting member 29 functions as a supporting portion that supports the cartridge 12 from below. As described below, the cartridge 12 inserted in the apparatus body 1A is positioned in accordance with the opening/closing operation of the front door 31 by the cartridge supporting member 29 moving in accordance with the opening/closing operation of the front door 31.

In the present embodiment, the guided portion 42 has a convex shape (protruded shape) when viewed in the Y direction, and the cartridge supporting member 29 has a concave shape for receiving the guided portion 42. However, the guided portion 42 may have a concave shape, and the cartridge supporting member 29 may have a convex shape. In addition, the cartridge supporting member 29 that serves as a guide member has only to have a shape that prevents the cartridge 12 from moving toward at least one direction that intersects the Y direction.

Link Unit

The cartridge supporting member 29 is supported by a link unit 54 (FIGS. 4A and 5A) that moves in accordance with the opening/closing operation of the front door 31, such that the cartridge supporting member 29 can move between a first position and a second position, with respect to the apparatus body 1A. The link unit 54 positions the cartridge supporting member 29 at the first position in the door close state in which the front door 31 is positioned at the closed position, and positions the cartridge supporting member 29 at the second position in the door open state in which the front door 31 is positioned at the open position.

The first position is a position (FIG. 1) with respect to the apparatus body 1A that allows the cartridge 12 to perform image forming operations. That is, the first position is a position of the cartridge supporting member 29, by which the cartridge 12 is positioned at a position at which the cartridge 12 can perform the image forming operations. In the present embodiment, the first position is a position of the cartridge supporting member 29 that causes the photosensitive drum 7 of the cartridge 12 supported by the cartridge supporting member 29 to be in contact with the intermediate transfer belt 18. The second position is a position to which the cartridge 12 is moved from the first position so that the cartridge 12 can be attached to and detached from the apparatus body 1A. In the present embodiment, the second position is lower than the first position, and when the cartridge supporting member 29 is located at the second position, the photosensitive drum 7 is separated from and located below the intermediate transfer belt 18.

As illustrated in FIGS. 4A and 5A, the link unit 54 includes a plurality of (four in the present embodiment) front-side arms 55, a link shaft 57, and a link lever 58. The front-side arms 55 are disposed, corresponding to the cartridge supporting members 29Y to 29K. The link shaft 57 is rotatably supported by the apparatus body 1A via bearings, and extends in the X direction. A rotation axis 57A of the link shaft 57 is substantially parallel (preferably parallel) with the axis B-B (FIG. 4A) of the front door 31, on which the front door 31 is pivoted by the opening/closing operation of the front door 31. Each of the front-side arms 55 is an arm portion that projects from the link shaft 57, which serves as a shaft portion, toward a direction that intersects the X direction (i.e., from the rotation axis toward the outside in the radial direction). That is, the plurality of front-side arms 55 are linked with each other via the link shaft 57, and rotate together with the link shaft 57. The link unit 54 that includes the link shaft 57 and the front-side arms 55 functions as a link member (first link member) of the present embodiment.

In addition, the link lever 58 is disposed at an end portion of the link shaft 57 in the X direction. The link lever 58 is coupled or connected with the link shaft 57 via a coupling pin so as not to rotate relative to the link shaft 57. Thus, the link lever 58 rotates together with the link shaft 57. As illustrated in FIG. 4B, the front door 31 is provided with an engaging portion 31*a* that engages with one portion (i.e., an engaged portion 58*a*) of the link lever 58. The engaging portion 31*a* is a projection that projects from the above-described guide rib 31*g* toward the X direction. The link lever 58 is held between the engaging portion 31*a* and a surface 31*b* of the front door 31. Thus, the front door 31 and the link lever 58 are engaged with each other, and the link lever 58 pivots on the link shaft 57 in accordance with the opening/closing operation of the front door 31. That is, since the link shaft 57 and the front-side arms 55 are engaged with the front door 31 via the link lever 58 that serves as an engagement member, the link shaft 57 and the front-side arms 55 pivot on the rotation axis of the link shaft 57 in accordance with the opening/closing operation of the front door 31.

In addition, the engaging portion 31*a* is formed so that the link lever 58 can slide on the engaging portion 31*a* while keeping the engagement state between the link lever 58 and the engaging portion 31*a*. Thus, the engagement state between the link lever 58 and the engaging portion 31*a* can be maintained, although the trajectory of pivot of the engaging portion 31*a* and the trajectory of pivot of the link lever 58 are different from each other because the center of pivot (i.e., the axis B-B in FIG. 4A) of the front door 31 and the axis of the link shaft 57, on which the link lever 58 pivots, are different from each other.

As illustrated in FIG. 4B, each of the front-side arms 55 is linked with a corresponding cartridge supporting member 29 via a connecting shaft 29*a*, so as to be able to pivot with the cartridge supporting member 29. The connecting shaft 29*a* is formed at a front-side end portion (i.e., upstream end portion in the insertion direction) of the cartridge supporting member 29. In addition, as illustrated in FIGS. 5A and 5B, a plurality of (four in the present embodiment) back-side arms 56 are disposed on the back side of the apparatus body 1A, corresponding to the cartridge supporting members 29Y to 29K. Each of the back-side arms 56 (second link members) is linked with a corresponding cartridge supporting member 29 via a connecting shaft 29*b*, so as to be able to pivot with the cartridge supporting member 29. The connecting shaft 29*b* is formed at a back-side end portion (i.e., downstream end portion in the insertion direction) of the cartridge supporting member 29. Each of the back-side arms 56 is supported by the apparatus body 1A so as to be able to rotate on an axis 56*a*. Note that the connecting shafts 29*a* and 29*b* may be shaft members integrated with the cartridge supporting member 29, shaft members integrated with the front-side arms 55 and/or the back-side arms 56, or shaft members separated from the cartridge supporting member 29, the front-side arms 55, and the back-side arms 56.

Note that the distance from the center of pivot of the front-side arm 55 to the axis of the connecting shaft 29*a* is substantially equal to the distance from the center of pivot of the back-side arm 56 to the axis of the connecting shaft 29*b*. In addition, the axis of the connecting shaft 29*a* and the axis of the connecting shaft 29*b* are substantially parallel with the axis of the link shaft 57. That is, the cartridge supporting member 29 is supported so as to be able to move with respect to the apparatus body 1A, by a parallelogram linkage constituted by the front-side arms 55 and the back-side arms 56.

When viewed in the X direction that is the axis direction of the link shaft 57, the cartridge supporting member 29 translates obliquely with respect to the Y direction and the Z direction. In other words, when the cartridge supporting member 29 moves from the second position (FIG. 4A) to the first position (FIG. 5A), the cartridge supporting member 29 moves backward (toward the +Y direction) and upward (toward the +Z direction) along an arc whose center is equal to the rotation axis 57A of the link shaft 57. On the other hand, when the cartridge supporting member 29 moves from the first position to the second position, the cartridge supporting member 29 moves frontward (toward the −Y direction) and downward (toward the −Z direction) along the above-described arc. In addition, since the parallelogram linkage is used, the cartridge supporting member 29 moves without changing its posture when viewed from the X direction.

The link unit 54 and the back-side arms 56 constitute a moving mechanism 59 of the present embodiment, which supports the cartridge supporting member 29 so that the cartridge supporting member 29 can move with respect to the apparatus body 1A, and which moves the cartridge supporting member 29 in accordance with the opening/closing operation of the front door 31. Note that a known mechanism other than the parallelogram linkage may be used as the mechanism that supports the cartridge supporting member 29 so that the cartridge supporting member 29 can move.

Urging of Moving Mechanism

The image forming apparatus 1 includes an urging member that urges the moving mechanism 59 for positioning the cartridge supporting member 29 at the second position in a state where the front door 31 is opened (door open state). As illustrated in FIGS. 4A and 5A, a plurality of (four in the present embodiment) tension springs 52 are disposed as urging members, corresponding to the cartridge supporting members 29Y to 29K.

As illustrated in FIG. 5B, each of the tension springs 52 is a spring member stretched between a first hook portion 29*c* and a second hook portion 30*c*. The first hook portion 29*c* is disposed on the cartridge supporting member 29, and the second hook portion 30*c* is disposed on a stay 30 that is one portion of the frame of the apparatus body 1A. Note that the stay 30 is a metal member that is located below the cartridge supporting members 29Y to 29K in the apparatus body 1A, and that extends in the X direction and the Y direction (see FIGS. 1, 4A, and 5A).

The first hook portion 29*c* is located on the front side in the Y direction and on the upper side in the Z direction, with respect to the second hook portion 30*c*. The tension spring 52 is a torsion coil spring; and the axis direction of the coil is substantially perpendicular to the X direction, and the coil is disposed along a direction that intersects obliquely with the Y direction and the Z direction. Thus, the urging force is applied from the tension spring 52 to the cartridge supporting member 29 frontward in the Y direction and downward in the Z direction. As described later, in each of the state where the front door 31 is opened (door open state) and the state where the front door 31 is closed (door close state), the cartridge supporting member 29 is positioned, depending on the urging force of the tension spring 52.

Note that the tension spring 52 is disposed outside the cartridge supporting member 29 that has a concave shape when viewed in the Y direction, and along one side portion 292 (FIG. 5B). Thus, in a case where the tension spring 52 is connected with the cartridge supporting member 29, the tension spring 52 does not interfere with the guided portion 42 of the cartridge 12, which is guided along the concave inner portion of the cartridge supporting member 29.

Operation Performed when Door is Opened and Closed

Figure 6A:
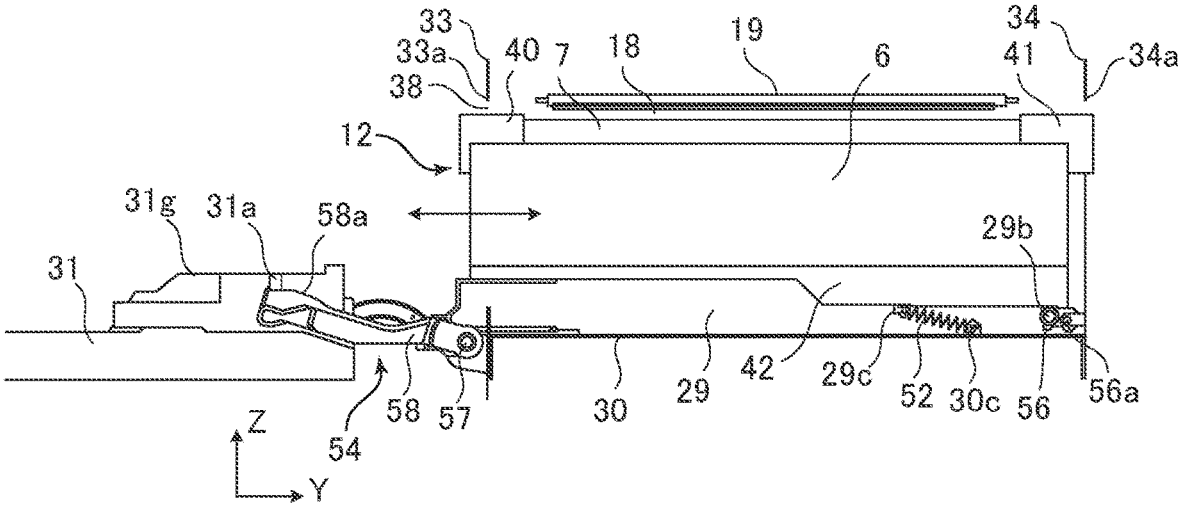
FIG. 6A is a diagram illustrating the door open state of the image forming apparatus of the first embodiment.
Figure 6B:
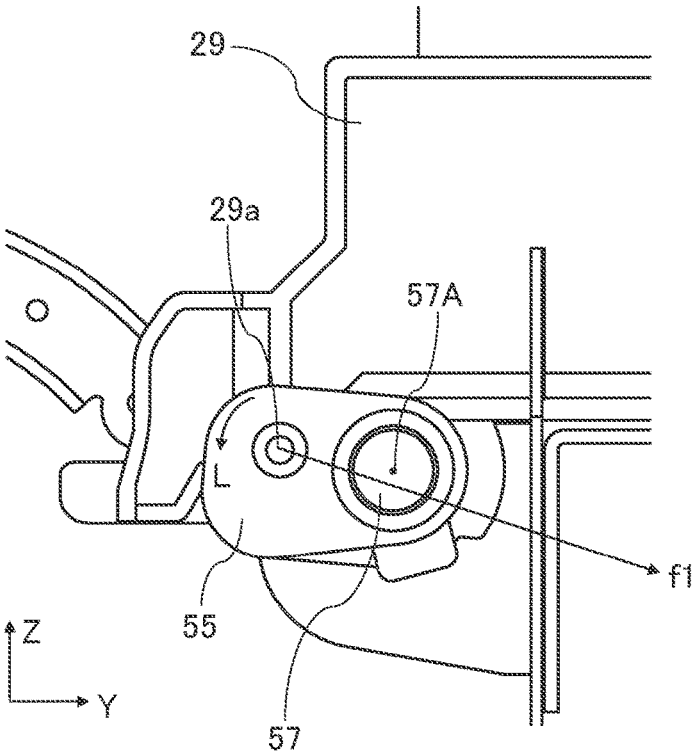
FIG. 6B is an enlarged view in which one portion of FIG. 6A is enlarged.
Figure 7A:
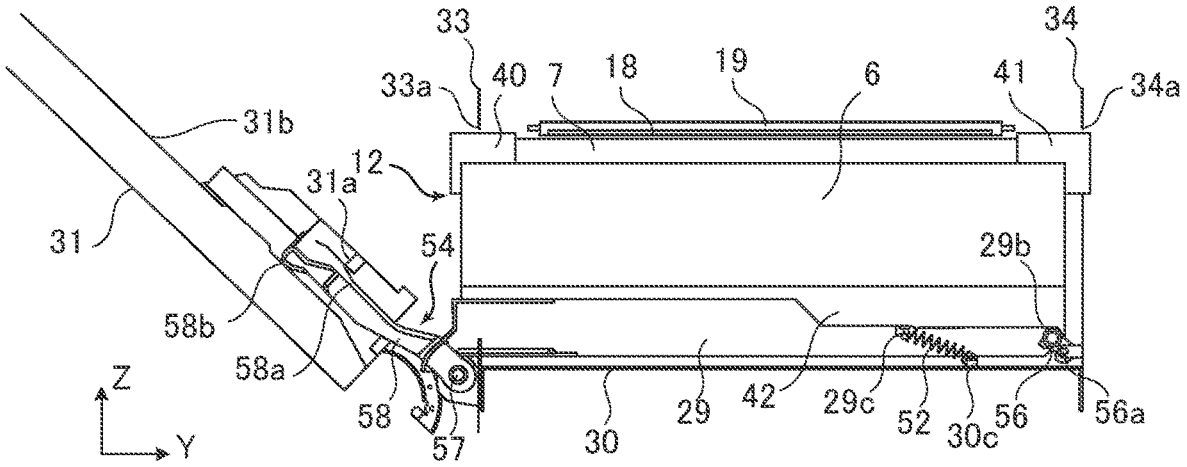
FIG. 7A is a diagram illustrating a state where the opening/closing operation of a front door of the image forming apparatus of the first embodiment is being performed.
Figure 7B:
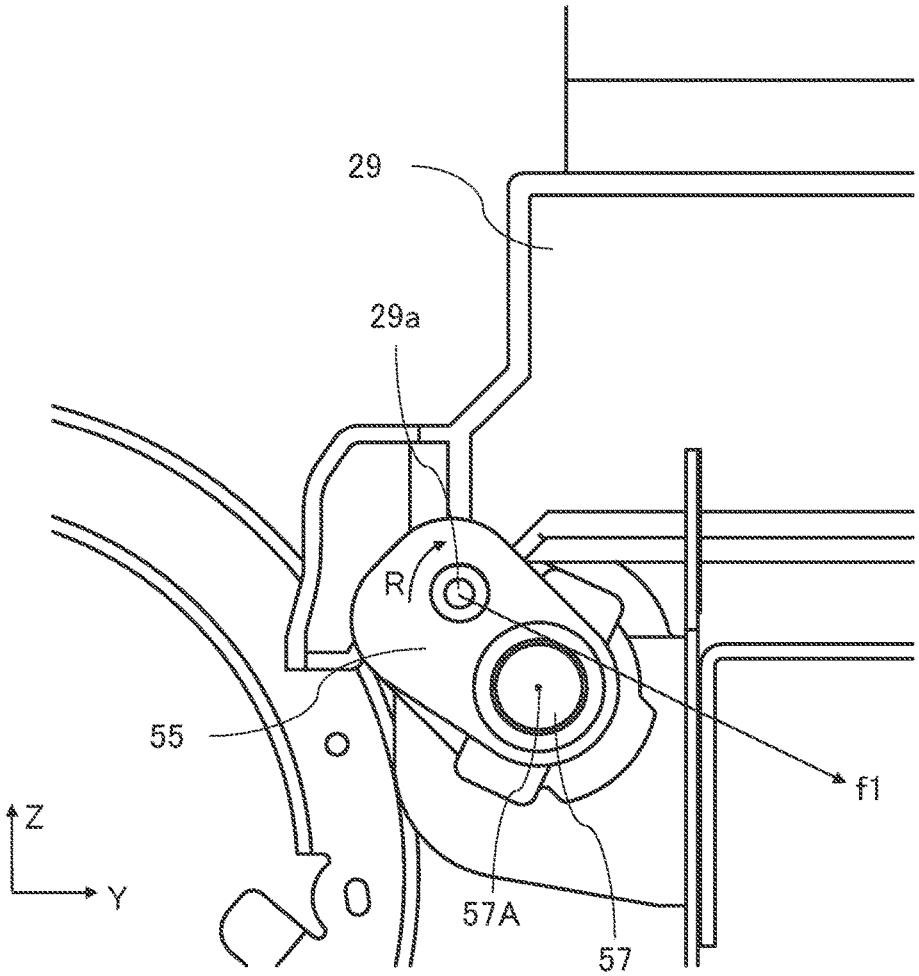
FIG. 7B is an enlarged view in which one portion of FIG. 7A is enlarged.
Figure 8A:
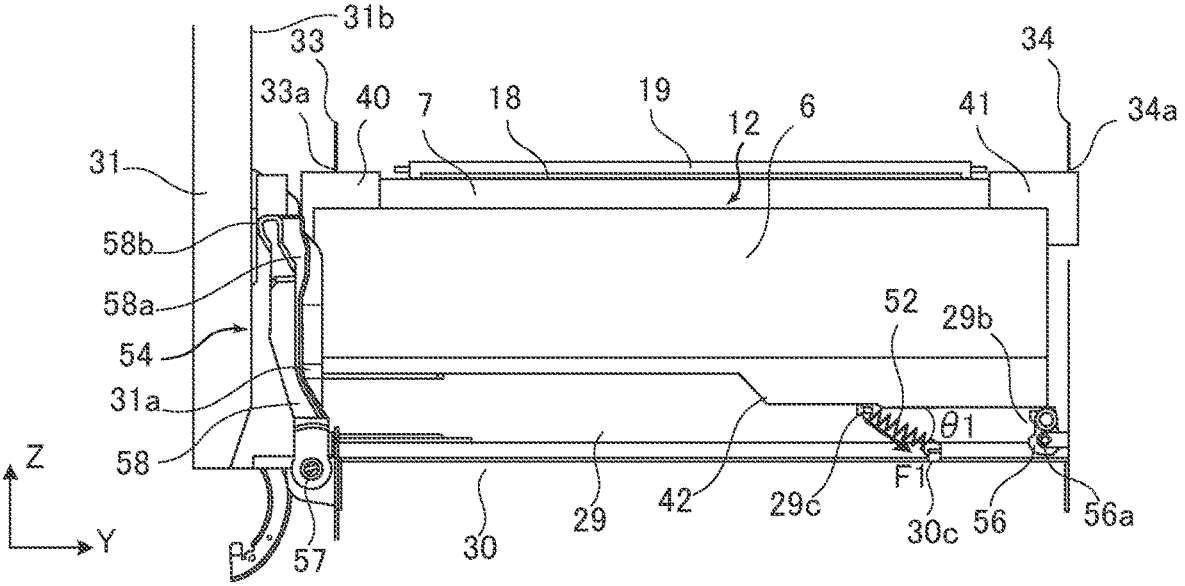
FIG. 8A is a diagram illustrating the door close state of the image forming apparatus of the first embodiment.
Figure 8B:
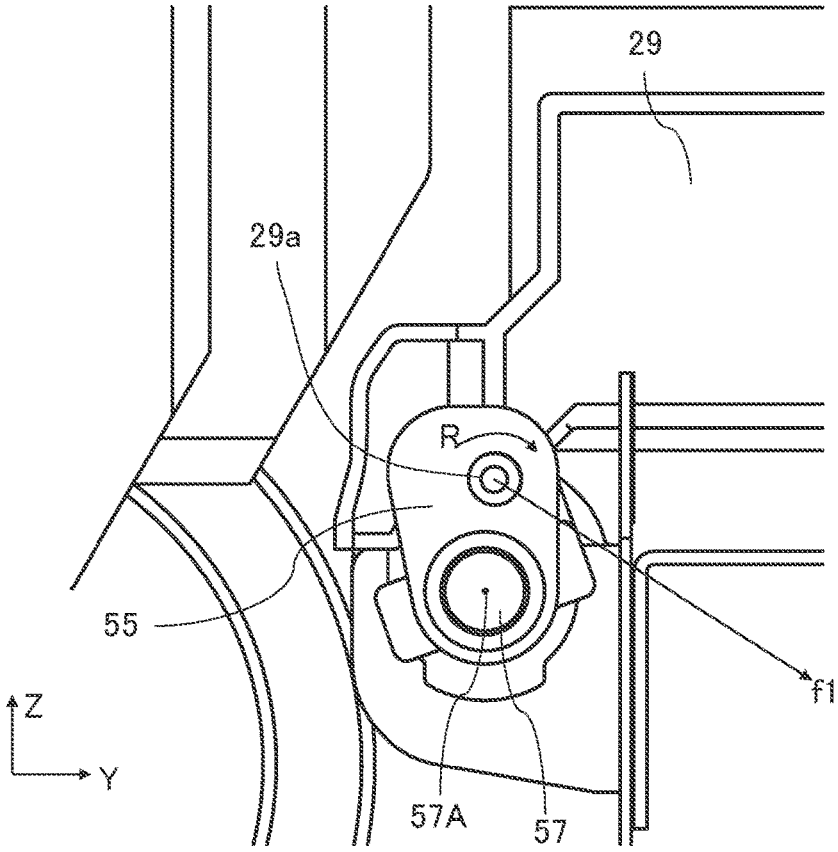
FIG. 8B is an enlarged view in which one portion of FIG. 8A is enlarged.

With reference to FIGS. 6A, 6B, 7A, 7B, 8A, and 8B, the description will be made for the position of the cartridge supporting member 29, the operation of the link unit 54, and the effect of the tension spring 52 in each of the open state and the close state of the front door 31. FIG. 6A is a diagram of one portion of the image forming apparatus 1, viewed in the X direction in the door open state. FIG. 7A is a diagram of one portion of the image forming apparatus 1, viewed in the X direction when the front door 31 is being opened or closed. FIG. 8A is a diagram of one portion of the image forming apparatus 1, viewed in the X direction in the door close state. FIG. 6B is an enlarged view in which one portion (i.e., the front-side arm 55 and its surroundings) of FIG. 6A is enlarged. FIG. 7B is an enlarged view in which one portion (i.e., the front-side arm 55 and its surroundings) of FIG. 7A is enlarged. FIG. 8B is an enlarged view in which one portion (i.e., the front-side arm 55 and its surroundings) of FIG. 8A is enlarged.

In the door open state illustrated in FIGS. 6A and 6B, the cartridge supporting member 29 is located at the second position. The cartridge 12 supported by the cartridge supporting member 29 is located at a position that causes the photosensitive drum 7 to be separated from the intermediate transfer belt 18. In this state, a user holds the cartridge 12 from the front side of the image forming apparatus 1, and pulls the cartridge 12 out frontward (toward the −Y direction) through the opening portion 38. When the user pulls the cartridge 12 out, the guided portion 42 of the cartridge 12 is guided by the cartridge supporting member 29 and the guide rib 31*g*. Thus, the cartridge 12 is suppressed from moving toward directions that intersect the Y direction, and the moving direction of the cartridge 12 is restricted to the −Y direction.

When the user fully pulls the cartridge 12 out and then attaches a new cartridge 12 to the apparatus body 1A, the user holds the new cartridge 12 such that the axis direction of the photosensitive drum 7 is set to the Y direction, and inserts the new cartridge 12 backward (toward the +Y direction), to the apparatus body 1A through the opening portion 38. Also in this case, the guided portion 42 of the cartridge 12 is guided by the cartridge supporting member 29 and the guide rib 31*g*. Thus, the cartridge 12 is suppressed from moving toward directions that intersect the Y direction, and the moving direction of the cartridge 12 is restricted to the +Y direction.

FIG. 6B illustrates an urging force f1 that is applied in the door open state, from the cartridge supporting member 29 to the front-side arm 55 of the link unit 54. The urging force f1 is produced by the tension spring 52 (FIG. 6A), and applied to the front-side arm 55, with the connecting shaft 29*a* between the cartridge supporting member 29 and the front-side arm 55 serving as a point of application. The direction of the urging force f1 is a direction in which the tension spring 52 pulls the cartridge supporting member 29 (i.e., the direction extending from the first hook portion 29*c* to the second hook portion 30*c* in FIG. 6A).

Depending on the positional relationship between the line drawn from the center of the connecting shaft 29*a* toward the direction of the urging force f1 and the rotation axis 57A of the link shaft 57, the urging force f1 produces a moment around the rotation axis 57*a* in a direction indicated by an arrow L, and the moment is applied to the front-side arm 55. The direction indicated by the arrow L is a direction in which the front-side arm 55 pivots when the cartridge supporting member 29 is moved from the first position to the second position. That is, in the door open state, the urging force of the tension spring 52 is applied to the link unit 54, which is a link member, in a direction (indicated by the arrow L) in which the cartridge supporting member 29 is retained at the second position.

The above description can also be made for the back-side arm 56, which and the front-side arm 55 constitute the parallelogram linkage. That is, the urging force of the tension spring 52 is applied to the back-side arm 56, with the connecting shaft 29*b* (FIG. 6A) between the cartridge supporting member 29 and the back-side arm 56 serving as a point of application; and produces a moment around the axis 56*a* counterclockwise in FIG. 6A, and the moment is applied to the back-side arm 56.

Thus, both the front-side arm 55 and the back-side arm 56 are urged by the urging force of the tension spring 52 toward the rotational direction in which the cartridge supporting member 29 is moved downward. Then at least one portion of the lower surface of the cartridge supporting member 29 abuts against the stay 30, which is one portion of the frame of the apparatus body 1A, in the Z direction, so that the cartridge supporting member 29 is positioned at the second position. That is, in the door open state, the urging force of the tension spring 52 is applied to the moving mechanism 59 of the cartridge supporting member 29, in a direction in which the cartridge supporting member 29 is retained at the second position.

Note that in the door open state, since the moment is applied to the front-side arm 55 by the urging force f1 of the tension spring 52 in the direction indicated by the arrow L, the urging force f1 is also applied to the front door 31, which is linked with the front-side arm 55 via the link lever 58. That is, in the door open state, the urging force f1 of the tension spring 52 is applied in a direction in which the front door 31 is retained at the open position.

As illustrated in FIG. 7A, when the front door 31 that has been opened is closed, the inner surface 31*b* of the front door 31 presses the pressing portion 58*b* of the link lever 58, so that the link unit 54 pivots clockwise in FIG. 7A. In addition, as illustrated in FIG. 7B, the front-side arm 55 of the link unit 54 pivots in a direction indicated by an arrow R, so that the cartridge supporting member 29 is lifted from the second position toward the first position. Note that the back-side arm 56 also pivots in the same direction as the direction indicated by the arrow R, at the same time as the time when the front-side arm 55 pivots (FIG. 7A). Thus, the cartridge supporting member 29 lifts while keeping its posture.

The cartridge supporting member 29 moves in accordance with the operation to close the front door 31, backward in the Y direction and upward in the Z direction (FIGS. 6A and 7A). Thus, the connecting shaft 29*a* that links the cartridge supporting member 29 and the front-side arm 55 also moves backward and upward, relative to the rotation axis 57A of the link shaft 57 (FIGS. 6B and 7B). That is, the position of the point of application of the urging force f1 of the tension spring 52, which is applied to the front-side arm 55, changes relative to the rotation axis 57A that is the center of pivot of the front-side arm 55. As a result, as illustrated in FIG. 7B, at a point of time in the movement of the front door 31 from the open position to the closed position, the urging force f1 of the tension spring 52 produces a moment applied to the front-side arm 55, around the rotation axis 57A in a direction indicated by the arrow R.

The direction indicated by the arrow R is a direction in which the front-side arm 55 pivots when the cartridge supporting member 29 is moved from the second position to the first position. That is, while the front door 31 is being opened or closed, the direction of the moment applied by the urging force of the tension spring 52 to the link unit 54 is changed. Similarly, while the front door 31 is being opened or closed, the direction of the moment applied by the urging force of the tension spring 52 to the back-side arm 56 is also changed.

As illustrated in FIG. 8A, in the door close state in which the front door 31 is located at the closed position, the cartridge supporting member 29 is located at the first position. Since the cartridge supporting member 29 is located at the first position, the cartridge 12 is positioned at a position at which the cartridge 12 can perform image forming operations, that is, at a position that causes the photosensitive drum 7 to abut against the intermediate transfer belt 18. When the cartridge 12 is positioned at the position, the front-side bearing 40 of the cartridge 12 abuts against a contact portion 33*a* of the front-side frame 33 of the apparatus body 1A, and the back-side bearing 41 of the cartridge 12 abuts against a contact portion 34*a* of the back-side frame 34 of the apparatus body 1A. In this manner, the cartridge 12 is positioned with respect to the apparatus body 1A in a direction that intersects the Y direction.

As illustrated in FIG. 8B, in the door close state, the urging force f1 of the tension spring 52 produces a moment applied to the front-side arm 55, around the rotation axis 57A in a direction indicated by the arrow R. As described above, the direction indicated by the arrow R is a direction in which the front-side arm 55 pivots when the cartridge supporting member 29 is moved from the second position to the first position. That is, in the door close state, the urging force of the tension spring 52 is applied to the link unit 54, which is a link member, in a direction (indicated by the arrow R) in which the cartridge supporting member 29 is retained at the first position.

The above description can also be made for the back-side arm 56. That is, the urging force of the tension spring 52 is applied to the back-side arm 56, with the connecting shaft 29*b* (FIG. 8A) between the cartridge supporting member 29 and the back-side arm 56 serving as a point of application; and produces a moment applied to the back-side arm 56, around the axis 56*a* clockwise in FIG. 8A.

Thus, both the front-side arm 55 and the back-side arm 56 are urged by the urging force of the tension spring 52 toward the rotational direction in which the cartridge supporting member 29 is moved upward. Then the front-side bearing 40 and the back-side bearing 41 of the cartridge 12 abut against the contact portions 33*a* and 34*a* of the apparatus body 1A, so that the cartridge supporting member 29 is positioned at the first position. That is, in the door close state, the urging force of the tension spring 52 is applied to the moving mechanism 59 of the cartridge supporting member 29, in a direction in which the cartridge supporting member 29 is retained at the first position.

Note that in the door close state, since the moment is applied to the front-side arm 55 by the urging force f1 of the tension spring 52 in the direction indicated by the arrow R, the urging force f1 is also applied to the front door 31, which is linked with the front-side arm 55 via the link lever 58. That is, in the door close state, the urging force f1 of the tension spring 52 is applied in a direction in which the front door 31 is retained at the closed position.

By the way, the front-side bearing 40 and the back-side bearing 41 abut against the contact portions 33*a* and 34*a* of the apparatus body 1A before the front door 31 reaches the closed position in the closing operation of the front door 31. When the front-side bearing 40 and the back-side bearing 41 abut against the contact portions 33*a* and 34*a*, the cartridge 12 receives reaction force from the front-side frame 33 and the back-side frame 34 in the vertical direction (i.e., −Z direction). The reaction force causes friction between the guided portion 42 of the cartridge 12 and a contact portion of the cartridge supporting member 29. As a result, the cartridge supporting member 29 receives a frictional force applied in the −Y direction. The tension spring 52 of the present embodiment, however, facilitates the cartridge supporting member 29 to be more reliably moved to the first position against the frictional force. That is, the urging force F1 of the tension spring 52 that pulls the hook portion 29*c* of the cartridge supporting member 29 includes a component applied in a direction (+Y direction) opposite to the direction in which the cartridge supporting member 29 receives the frictional force from the cartridge 12. Preferably, the component F1 cos θ1 is equal to or larger than the above-described frictional force, where θ1 is an angle between the urging force F1 applied from the tension spring 52 to the hook portion 29*c* and the horizontal direction.

As described above, the image forming apparatus 1 of the present embodiment includes the apparatus body 1A, the front door 31 configured to be opened and closed with respect to the apparatus body 1A, and the cartridge 12 configured to be inserted to the apparatus body 1A in a state where the front door 31 is opened. The cartridge 12 is configured to be able to be pulled out from the apparatus body 1A. The image forming apparatus 1 further includes the cartridge supporting member 29 configured to guide the cartridge 12 for the cartridge 12 to be inserted into and pulled out from the apparatus body 1A. The cartridge supporting member 29 is also configured to support the cartridge 12 inserted into the apparatus body 1A. The image forming apparatus 1 further includes the moving mechanism 59 configured to support the cartridge supporting member 29 such that the cartridge supporting member 29 can move between the first position and the second position, and move the cartridge supporting member 29 from the second position to the first position in accordance with the operation to close the front door 31 that is opened. The first position is a position that allows the cartridge 12 to perform image forming operations, and the second position is a position that allows the cartridge 12 to be pulled out from the apparatus body 1A. The image forming apparatus 1 further includes the tension spring 52 configured to urge the moving mechanism in a state where the front door 31 is opened, for the cartridge supporting member 29 to be retained at the second position.

In such a configuration, in a state where the front door 31 is opened, the cartridge supporting member 29 is positioned at the second position with high accuracy by the urging force of the tension spring 52. Thus, the operability for attaching and detaching the cartridge that is guided by the cartridge supporting member 29 can be increased. For example, the possibility that the front-side bearing 40 and the back-side bearing 41 of the cartridge 12 interfere with the contact portions 33*a* and 34*a* of the apparatus body 1A when the cartridge 12 is attached to or detached from the apparatus body 1A can be reduced. In addition, since the front-side bearing 40 and the back-side bearing 41 hardly interfere with the contact portions 33*a* and 34*a*, the size of the opening portion 38 can be reduced as much as possible, or the amount of movement of the cartridge supporting member 29 between the first position and the second position (i.e., distance by which the cartridge supporting member 29 moves up and down) can be reduced as much as possible. As a result, the image forming apparatus 1 can be downsized.

Modification 1

In the first embodiment, the plurality of cartridge supporting members 29, the plurality of front-side arms 55, and the plurality of back-side arms 56 are disposed, corresponding to the plurality of cartridges 12. However, the present disclosure can also be applied to an image forming apparatus with a single cartridge 12. In this case, a single cartridge supporting member 29, a single front-side arm 55, and a single back-side arm 56 may be disposed, corresponding to the single cartridge 12.

Modification 2

In the first embodiment, the tension spring 52, which is an urging member, is connected to the cartridge supporting member 29, and the urging force f1 of the tension spring 52 is applied to the front-side arm 55 (link unit 54) and the back-side arm 56 via the cartridge supporting member 29.

Instead of this, the urging member may be directly connected to the front-side arm 55 (link unit 54) or the back-side arm 56 (that is, the urging member may directly urge the components of the moving mechanism 59).

For example, a tension spring may be stretched between the front-side arm 55 or the back-side arm 56 and the frame of the apparatus body 1A. Also in this case, the moment has only to be applied to the front-side arm 55 or the back-side arm 56 in the door open state, by the urging force of the urging member in a direction (indicated by the arrow L) in which the cartridge supporting member 29 is retained at the second position, as described with reference to FIGS. 6A and 6B. In addition, it is more preferable that the moment be applied to the front-side arm 55 or the back-side arm 56 in the door close state, by the urging force of the urging member in a direction (indicated by the arrow R) in which the cartridge supporting member 29 is retained at the first position, as described with reference to FIGS. 8A and 8B.

In addition, a plate spring or a helical spring may be used as the urging member, at least if the urging member can urge the moving mechanism 59 in the door open state, in a direction in which the cartridge supporting member 29 is retained at the second position. In another case, a plurality of types of urging member may be used, combined with each other. In another case, a plurality of cartridge supporting members 29 may be positioned by a single urging member (e.g., one of the four tension springs 52 in the first embodiment, or a spring of Modification 2 that urges the link unit 54).

Second Embodiment

Next, a second embodiment will be described. Note that a component identical to a component described in the first embodiment is given an identical symbol, and the description thereof will be omitted. The present embodiment differs from the first embodiment in the connection between the front-side arm 55 and a front-side end portion of the cartridge supporting member 29.

Figure 9A:
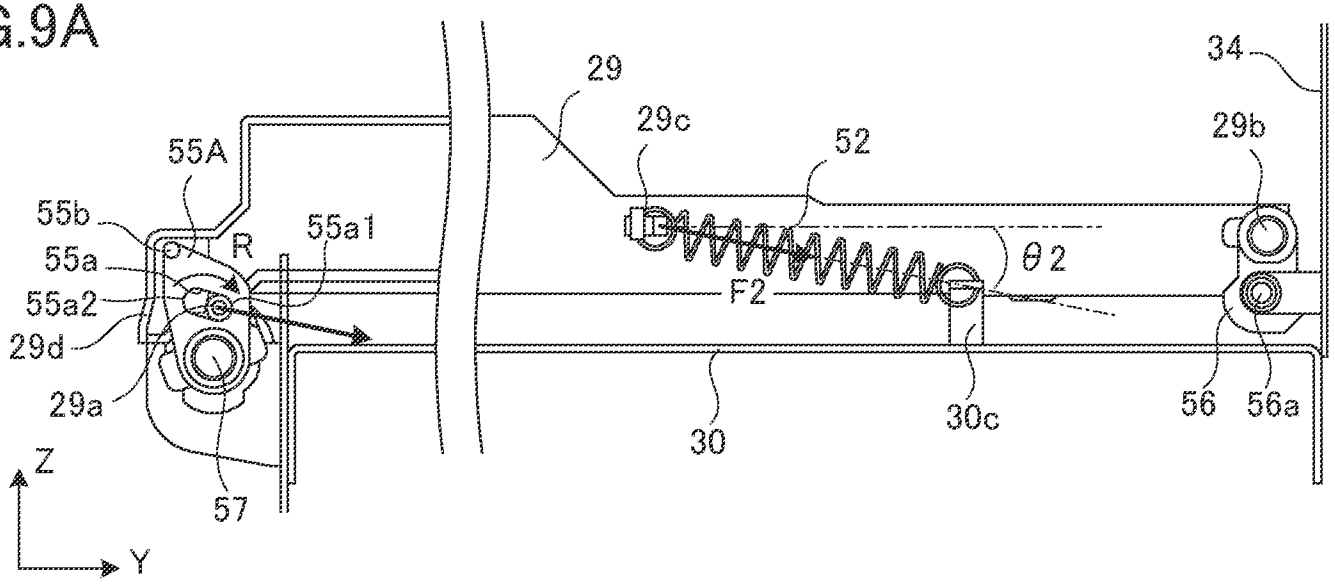
FIG. 9A is a diagram illustrating a cartridge supporting member, a front-side arm, and other components of a second embodiment.
Figure 9B:
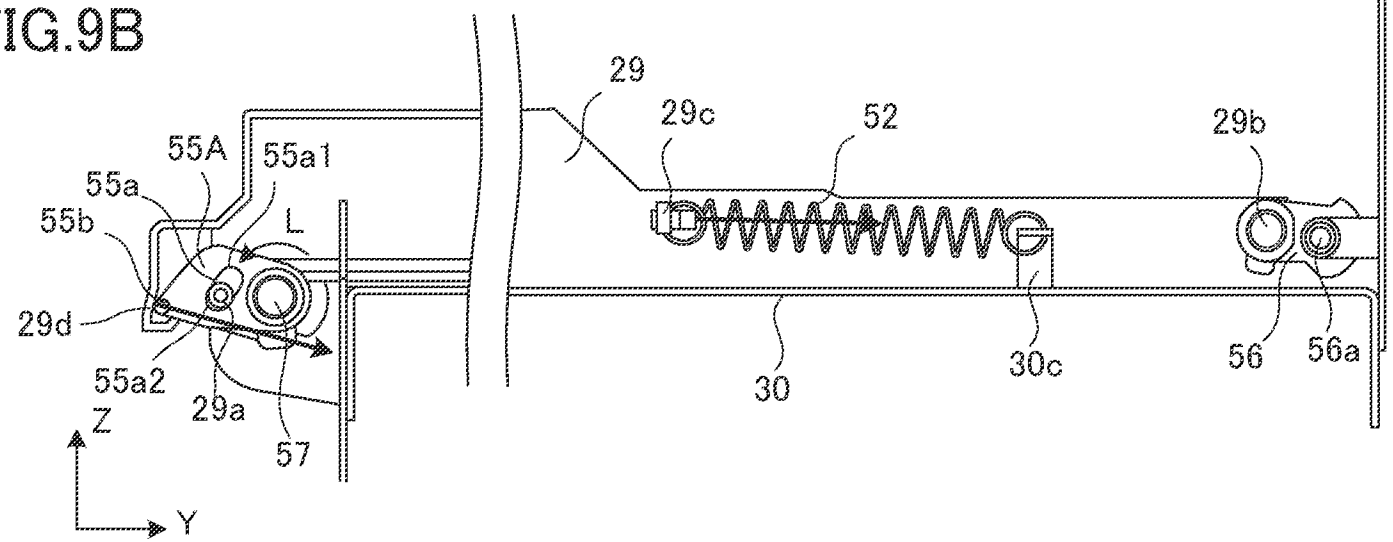
FIG. 9B is a diagram illustrating the cartridge supporting member, the front-side arm, and the other components of the second embodiment.

FIGS. 9A and 9B are diagrams of the cartridge supporting member 29 and its surroundings of the second embodiment, viewed from the +X direction. FIG. 9A illustrates a door close state, and FIG. 9B illustrates a door open state. Note that a center portion of the cartridge supporting member 29 in the Y direction is not illustrated.

As in the first embodiment, the cartridge supporting member 29 is moved in accordance with the opening/closing operation of the front door 31, by the link unit 54 engaged with the front door 31 and serving as a link member. That is, the cartridge supporting member 29 is positioned at the first position in the door close state (FIG. 9A) and at the second position in the door open state (FIG. 9B).

As illustrated in FIGS. 9A and 9B, a front-side arm 55A of the present embodiment includes an engagement hole portion 55*a* and an abutted portion 55*b*. The engagement hole portion 55*a* engages with the connecting shaft 29*a* disposed on a front-end portion of the cartridge supporting member 29. The abutted portion 55*b* is a portion against which an abutment portion 29*d* of the front-end portion of the cartridge supporting member 29 abuts. The engagement hole portion 55*a* has a long hole, and in a state of FIG. 9A (i.e., door close state) where the cartridge supporting member 29 is positioned at the first position, the connecting shaft 29*a* is in contact with a first edge portion 55*a*1 of the engagement hole portion 55*a*. In a state of FIG. 9B (door open state) where the cartridge supporting member 29 is positioned at the second position, the abutted portion 55*b* is in contact with the abutment portion 29*d* located in front of the abutted portion 55*b*. Note that in the state of FIG. 9B where the cartridge supporting member 29 is positioned at the second position, the connecting shaft 29*a* is located between the first edge portion 55*a*1 and a second edge portion 55*a*2 of the engagement hole portion 55*a*. In addition, in the state of FIG. 9A where the cartridge supporting member 29 is positioned at the first position, the abutted portion 55*b* is not in contact with the abutment portion 29*d*.

When the front door 31 is opened in the door close state illustrated in FIG. 9A, the front-side arm 55A of the link unit 54 pivots counterclockwise in FIG. 9A, in accordance with the operation to open the front door 31. In this case, the first edge portion 55*a*1 of the engagement hole portion 55*a* presses the connecting shaft 29*a*, so that the cartridge supporting member 29 starts to move from the first position toward the second position (i.e., starts to move frontward and downward).

When the front door 31 is closed in the door open state illustrated in FIG. 9B, the front-side arm 55A of the link unit 54 pivots clockwise in FIG. 9B, in accordance with the operation to close the front door 31. In this case, the second edge portion 55*a*2 of the engagement hole portion 55*a* presses the connecting shaft 29*a*, so that the cartridge supporting member 29 starts to move from the second position toward the first position (i.e., starts to move backward and upward).

In this manner, the cartridge supporting member 29 and the front-side arm 55A are connected with each other so as to pivot with each other and slide on each other within a predetermined range. In addition, the cartridge supporting member 29 is moved by the front-side arm 55A between the first position and the second position in accordance with the opening/closing operation of the front door 31. In addition, since the back-side arm 56 pivots at the same time when the front-side arm 55A pivots, the cartridge supporting member 29 moves up and down while keeping its posture.

Next, effects of the tension spring 52 that serves as an urging member will be described. The tension spring 52 is disposed at the same position as that in the first embodiment. That is, the tension spring 52 is stretched between the first hook portion 29*c* of the cartridge supporting member 29 and the second hook portion 30*c* of the stay 30 of the apparatus body 1A, and applies an urging force F2 that pulls the cartridge supporting member 29 frontward and downward.

As illustrated in FIG. 9A, in the door close state, the connecting shaft 29*a* of the cartridge supporting member 29 is in contact with the first edge portion 55*a*1 of the engagement hole portion 55*a* of the front-side arm 55A, and presses the first edge portion 55*a*1 due to the urging force of the tension spring 52. The direction in which the connecting shaft 29*a* presses the first edge portion 55*a*1 is the direction in which the urging force F2 of the tension spring 52 pulls the cartridge supporting member 29. Thus, a moment is applied to the front-side arm 55A by the urging force of the tension spring 52, in a direction indicated by the arrow R, that is, in a direction in which the cartridge supporting member 29 is retained at the first position.

As illustrated in FIG. 9B, in the door open state, the abutment portion 29*d* of the cartridge supporting member 29 is in contact with the abutted portion 55*b* of the front-side arm 55A, and presses the abutted portion 55*b* due to the urging force of the tension spring 52. The direction in which the abutment portion 29*d* presses the abutted portion 55*b* is determined, depending on the angle of a contact plane between the abutment portion 29*d* and the abutted portion 55*b*. In the present embodiment, since the abutted portion

55*b* is shaped like a round shaft, the direction is determined, depending on the angle of the surface of the abutment portion 29*d*. The abutment portion 29*d* of the present embodiment is formed such that the normal vector of the abutment portion 29*d* extends through a space below the rotation axis 57A of the link shaft 57 in FIG. 9B. Thus, a moment is applied to the front-side arm 55A by the urging force of the tension spring 52, in a direction indicated by the arrow L, that is, in a direction in which the cartridge supporting member 29 is retained at the second position.

Thus, also in the present embodiment in which the connection between the front-side arm 55A and the cartridge supporting member 29 is different from that of the first embodiment, the cartridge supporting member 29 can be positioned at the first position or the second position by the urging force of the tension spring 52, in both the door open state and the door close state. Thus, the present embodiment can also produce the same advantages as those produced by the first embodiment.

In addition, in the present embodiment, the magnitude of the moment applied in the door open state to the front-side arm 55A in the direction indicated by the arrow L can be easily adjusted. For example, in the present embodiment, the abutment position between the abutment portion 29*d* and the abutted portion 55*b* that is a point of application of the urging force of the tension spring 52, and the orientation of the contact plane between the abutment portion 29*d* and the abutted portion 55*b* that is a direction of application of the urging force can be changed. Thus, the distance (i.e., moment arm length) from the rotation axis 57A of the link shaft 57 to the line of application of force, along which the urging force of the tension spring 52 is applied to the front-side arm 55A, can be easily changed. The above-described line of application of force is a straight line that passes through the abutment position between the abutment portion 29*d* and the abutted portion 55*b*, which is a point of application of the urging force of the tension spring 52, and that is perpendicular to the contact plane between the abutment portion 29*d* and the abutted portion 55*b*. Thus, if the tension spring 52 of the present embodiment has the same spring constant as that of the tension spring 52 of the first embodiment, a larger moment can be produced in the direction indicated by the arrow L, and thus the cartridge supporting member 29 can be more reliably retained at the second position.

In addition, the abutment portion 29*d* and the abutted portion 55*b* function as a cam portion that changes the direction of the urging force F2, which the cartridge supporting member 29 receives from the tension spring 52 and which is applied from the cartridge supporting member 29 to the front-side arm 55A, as described above. Thus, the direction of the urging force F2 of the tension spring 52 can be more freely set. For example, an angle θ2 illustrated in FIG. 9A and formed between the direction of the urging force F2 and the horizontal direction in a state where the cartridge supporting member 29 is positioned at the first position can be made smaller than the angle θ1 (FIG. 8A) of the first embodiment. In this case, in FIG. 9A, the distance (i.e., moment arm length) from the rotation axis 57A of the link shaft 57 to the line of application of force, along which the urging force of the tension spring 52 is applied to the front-side arm 55A, is made longer than the distance of the first embodiment. Thus, if the tension spring 52 of the present embodiment has the same spring constant as that of the tension spring 52 of the first embodiment, a larger moment can be produced in the direction indicated by the arrow R, and thus the cartridge supporting member 29 can be more reliably retained at the first position.

As described above, in the configuration of the present embodiment, if the force of the tension spring 52 that pulls the cartridge supporting member 29 is the same as that of the first embodiment, the cartridge supporting member 29 can be more strongly retained at the first position or the second position in both of the door open state and the door close state. For example, a spring with a smaller spring constant may be used as the tension spring 52. In this case, since the strength required for the cartridge supporting member 29 is reduced, the cartridge supporting member 29 can be downsized, lightened in weight, and reduced in cost.

Third Embodiment

Next, a third embodiment will be described. Note that a component identical to a component described in the first or the second embodiment is given an identical symbol, and the description thereof will be omitted. In the present embodiment, the connection between the cartridge supporting member 29 and the front-side arm 55 described in the first embodiment and the connection between the cartridge supporting member 29 and the front-side arm 55A described in the second embodiment are combined with each other and used.

Figure 10A:
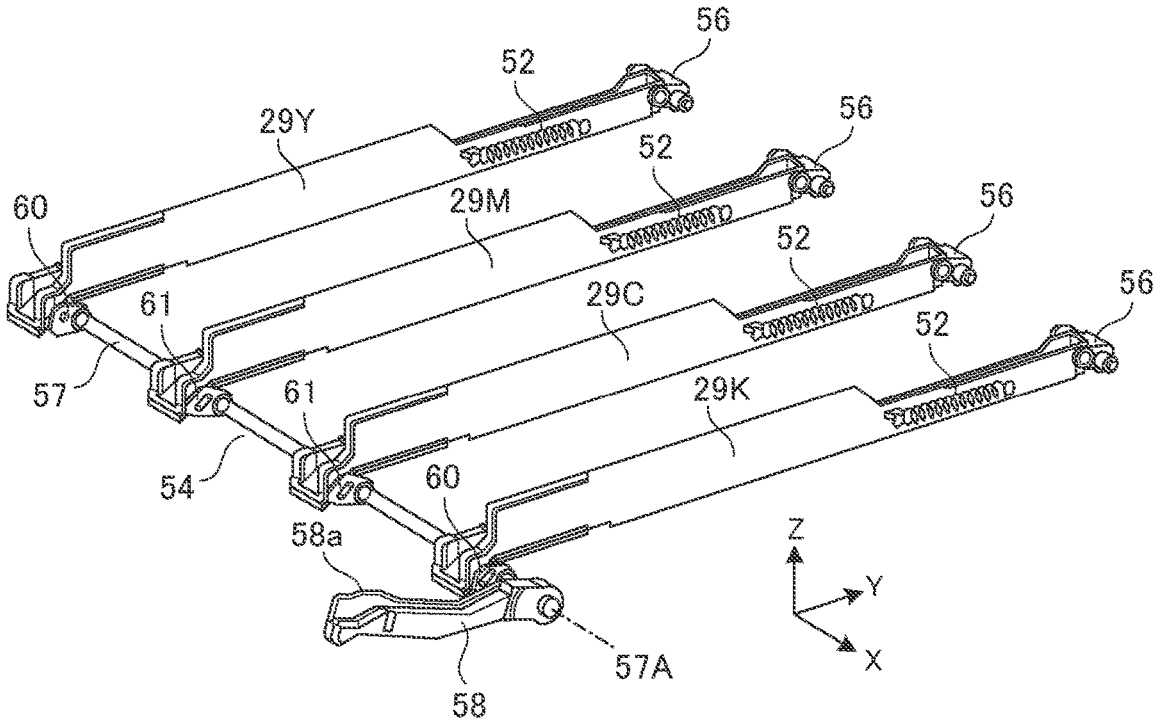
FIG. 10A is a perspective view of cartridge supporting members and other components of a third embodiment.

FIG. 10A is a perspective view illustrating the cartridge supporting members 29Y to 29K, the link unit 54, and their surroundings of the third embodiment that are in a door open state. Of the four cartridge supporting members 29Y to 29K, two cartridge supporting members 29Y and 29K are connected with front-side arms 60 that are a first type, and the other two cartridge supporting members 29M and 29C are connected with front-side arms 61 that are a second type. All of the four front-side arms 60 and 61 are attached to the link shaft 57, and constitute the link unit 54. In addition, the link lever 58 is disposed at one end portion of the link shaft 57 in the rotation-axis direction of the link shaft 57.

Figure 10B:
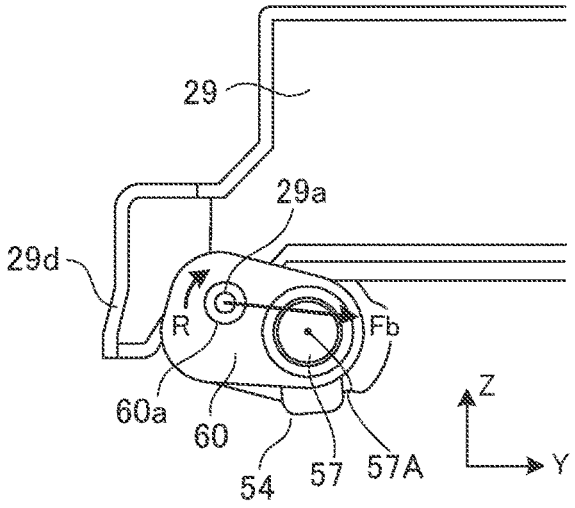
FIG. 10B is a diagram illustrating one type of front-side arm.

FIG. 10B illustrates a first-type front-side arm 60 and its surroundings viewed in the X direction. The first-type front-side arm 60 has a substantially circular shaft hole portion 60*a* that pivotally engages with the connecting shaft 29*a* of the cartridge supporting member 29. In a state where the cartridge supporting member 29 is located at the second position, the tension spring 52 pulls the cartridge supporting member 29, and the connecting shaft 29*a* presses the shaft hole portion 60*a*. As a result, an urging force Fb is applied to the front-side arm 60. The direction of the urging force Fb is a direction in which the tension spring 52 pulls the cartridge supporting member 29.

Figure 10C:
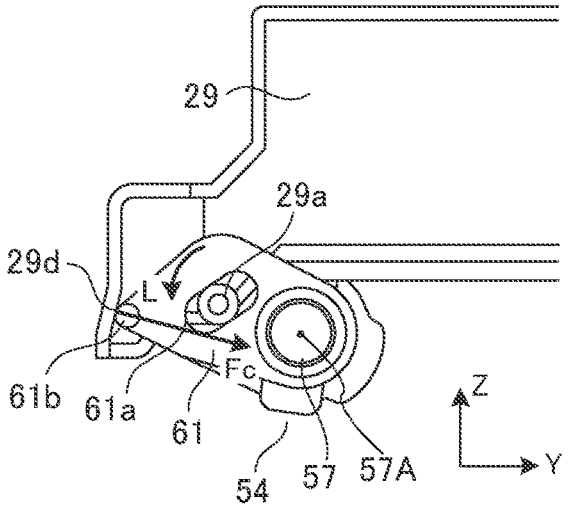
FIG. 10C is a diagram illustrating another type of front-side arm.

FIG. 10C illustrates a second-type front-side arm 61 and its surroundings viewed in the X direction. The second-type front-side arm 61 includes an engagement hole portion 61*a* and an abutted portion 61*b*. The engagement hole portion 61*a* has a long hole that engages with the connecting shaft 29*a* of the cartridge supporting member 29 such that the engagement hole portion 61*a* can pivot together with the connecting shaft 29*a* and slide on the connecting shaft 29*a*. The abutted portion 61*b* is a portion against which the abutment portion 29*d* of the cartridge supporting member 29 abuts. In a state where the cartridge supporting member 29 is located at the second position, the tension spring 52 pulls the cartridge supporting member 29, and the abutment portion 29*d* of the cartridge supporting member 29 is in contact with the abutted portion 61*b* of the front-side arm 61. As a result, an urging force Fc is applied to the front-side arm 61. The direction of the urging force Fc is perpendicular to a contact plane between the abutment portion 29*d* and the abutted portion 61*b*.

As illustrated in FIGS. 10B and 10C, in a state (i.e., door open state) where the cartridge supporting member 29 is located at the second position, the direction of the moment applied to the first-type front-side arm 60 is different from the direction of the moment applied to the second-type front-side arm 61. The urging force Fb of the tension spring 52 applies the moment to the first-type front-side arm 60 in a direction indicated by the arrow R, which is a direction of pivot in which the cartridge supporting member 29 is moved from the second position to the first position. In contrast, the urging force Fc of the tension spring 52 applies the moment to the second-type front-side arm 61 in a direction indicated by the arrow L, which is a direction of pivot in which the cartridge supporting member 29 is moved from the first position to the second position.

In addition, the total of moments applied to the two first-type front-side arms 60, which correspond to the cartridge supporting members 29Y and 29K, is smaller than the total of moments applied to the two second-type front-side arms 61, which correspond to the cartridge supporting members 29M and 29C. As a result, the whole of moments is applied to the whole link unit 54 around the rotation axis 57A of the link shaft 57 in a direction indicated by the arrow L, which is a direction in which the cartridge supporting member 29 is retained at the second position.

That is, in the present embodiment, at least one of the plurality of tension springs 52 produces a moment in the door open state, applied around the rotation axis 57A in a first direction (indicated by the arrow R). The whole of the plurality of tension springs 52 produces a moment in the door open state, applied to the link unit 54 around the rotation axis 57A in a second direction (indicated by the arrow L). Thus, also in the present embodiment, as in the first and the second embodiments, the cartridge supporting member 29 can be positioned at the second position in the door open state, by the urging forces Fb and Fc of the tension springs 52.

By the way, in the first and the second embodiments, the moments applied to the front-side arms 55 or 55A are produced in an identical direction. Thus, a large torsion force may be applied between one end portion of the link shaft 57 that is retained by the link lever 58 and the other end portion of the link shaft 57 opposite to the one end portion. Thus, for ensuring sufficient strength of the link shaft 57, the link shaft 57 has a sufficient shaft diameter, and is made of a material having sufficient rigidity.

In the present embodiment, however, some of the moments applied by the urging forces around the rotation axis 57A are canceled in the configuration in which the urging forces of the plurality of tension springs 52 are applied in the door open state, to the link unit 54 via the plurality of front-side arms 60 and 61. Thus, the torsion force applied to the link shaft 57 can be made smaller than in the first and the second embodiments. Since the strength necessary for the link shaft 57 can be made smaller, the shaft diameter of the link shaft 57 can be made smaller, or can be made of inexpensive material. Thus, the apparatus can be downsized or reduced in cost.

Note that in the present embodiment, the outer two front-side arms 60 of the four front-side arms 60 and 61 disposed in the X direction are the first type, and the inner two front-side arms 61 are the second type. However, the number and the arrangement pattern of the first type and the second type can be changed. In this case, the moment applied in the door open state to the link unit 54 by the whole of the four tension springs 52 has only to be produced in a direction indicated by the arrow L of FIG. 10C.

Modifications

In each of the above-described embodiments, the description has been made for the electrophotographic image forming apparatus with an intermediate-transfer tandem system. However, the present disclosure can also be applied to another image forming apparatus with a different system as long as the image forming apparatus includes a cartridge that can be detachably attached to the apparatus body. For example, the present disclosure may be applied to an image forming apparatus in which a plurality of process cartridges is disposed along a conveyance belt that conveys a recording material, and in which a toner image is directly transferred from an image bearing member of each process cartridge to the recording material conveyed by the conveyance belt. In another case, the present disclosure may be applied to a monochrome image forming apparatus that includes only one process cartridge.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-017006, filed on Feb. 5, 2021, which is hereby incorporated by reference herein in its entirety.

What is claimed is:

1. An image forming apparatus comprising:

an apparatus body;

an opening/closing member configured to rotate between a closed position in which the opening/closing member closes an opening portion provided in the apparatus body and an open position in which the opening/closing member opens the opening portion;

a cartridge configured to be inserted into and pulled out from the apparatus body through the opening portion in a state where the opening/closing member is in the open position;

a supporting member configured to support the cartridge inserted into the apparatus body, the supporting member being configured to guide the cartridge while the cartridge is being inserted into and pulled out from the apparatus body;

a moving mechanism including an arm portion configured to rotate in a first direction about a rotational axis so as to move the supporting member from a second position to a first position in accordance with a rotation of the opening/closing member from the open position to the closed position, and configured to rotate in a second direction about the rotational axis to move the supporting member from the first position to the second position in accordance with a rotation of the opening/closing member from the closed position to the open position, the first position being a position in which the cartridge supported by the supporting member is allowed to be used for performing an image forming operation, the second position being a position in which the cartridge is allowed to be inserted into and be pulled out from the apparatus body, the arm portion extending in a direction that intersects the rotational axis and having a connected portion pivotally connected with the supporting member; and an urging member configured to urge the supporting member or the moving mechanism such that a rotation moment in the second direction around the rotational axis is applied to the arm portion in a state where the opening/closing member is in the open position.

2. The image forming apparatus according to claim 1, wherein the urging member is configured to urge the supporting member or the moving mechanism such that a rotation moment in the first direction around the rotational axis is applied to the arm portion in a state where the opening/closing member is in the closed position.

3. The image forming apparatus according to claim 1, wherein the urging member is a spring attached to the supporting member, and wherein an urging force of the spring is applied to the arm portion of the moving mechanism via the supporting member.

4. The image forming apparatus according to claim 1, wherein the urging member is connected with the supporting member, wherein the supporting member includes an abutment portion configured to abut against a portion of the arm portion at a position different from the connected portion of the arm portion, and wherein in the state where the opening/closing member is in the open position, an urging force of the urging member is applied to the arm portion via the abutment portion.

5. The image forming apparatus according to claim 1, wherein the cartridge includes a rotatable image bearing member, wherein the opening portion provided in the apparatus body is open toward one side of the image bearing member in a rotation-axis direction of the image bearing member, and wherein the cartridge is allowed to be inserted into the apparatus body through the opening portion along the rotation-axis direction in the state where the opening/closing member is in the open position.

6. The image forming apparatus according to claim 5, wherein the cartridge includes a bearing configured to rotatably support the image bearing member, wherein the apparatus body includes a contact portion configured to position the cartridge by abutting against the bearing in a state where the supporting member is positioned at the first position, and wherein an urging force received by the supporting member from the urging member has a component in a direction extending along the rotation-axis direction of the image bearing member, and the component is opposite in direction to a frictional force applied to the supporting member by the cartridge when the bearing abutting against the contact portion when the supporting member is moved from the second position to the first position.

7. The image forming apparatus according to claim 1, wherein when the cartridge, the arm portion, the supporting member, the connected portion, and the urging member are a first cartridge, a first arm portion, a first supporting member, a first connected portion, and a first urging member, respectively, the image forming apparatus further comprises a second cartridge, and wherein the apparatus body includes a second supporting member configured to support the second cartridge inserted into the apparatus body and configured to guide the second cartridge while the second cartridge is being inserted into and pulled out from the apparatus body, wherein the moving mechanism includes:

a second arm portion configured to rotate in the first direction about the rotational axis so as to move the second supporting member from a third position to a fourth position in accordance with the rotation of the opening/closing member from the open position to the closed position, and configured to rotate in the second direction to move the second supporting member from the fourth position to the third position in accordance with the rotation of the opening/closing member from the closed position to the open position, the third position being a position in which the second cartridge supported by the second supporting member is allowed to be used for performing the image forming operation, the fourth position being a position in which the second cartridge is allowed to be inserted into and be pulled out from the apparatus body, the second arm portion extending in a direction that intersects the rotational axis and having a second connected portion pivotally connected with the second supporting member;

a second urging member configured to urge the second supporting member or the moving mechanism such that a rotation moment in the second direction around the rotational axis is applied to the second arm portion in the state where the opening/closing member is in the open position; and a shaft portion which is rotatable about the rotational axis and extending in a direction of the rotational axis, and to which the first arm portion and the second arm portion are fixed such that the first arm portion and the second arm portion are arranged in the direction of the rotational axis.

8. The image forming apparatus according to claim 1, wherein when the cartridge, the arm portion, the supporting member, the connected portion, and the urging member are a first cartridge, a first arm portion, a first supporting member, a first connected portion, and a first urging member, respectively, the image forming apparatus further comprises a second cartridge, and wherein the apparatus body includes a second supporting member configured to support the second cartridge inserted into the apparatus body and configured to guide the second cartridge while the second cartridge is inserted into and pulled out from the apparatus body, wherein the moving mechanism includes:

a second arm portion configured to rotate in the first direction about the rotational axis so as to move the second supporting member from a third position to a fourth position in accordance with the rotation of the opening/closing member from the open position to the closed position, and configured to rotate in the second direction to move the second supporting member from the fourth position to the third position in accordance with the rotation of the opening/closing member from the closed position to the open position, the third position being a position in which the second cartridge supported by the second supporting member is allowed to be used for performing the image forming operation, the fourth position being a position in which the second cartridge is allowed to be inserted into and be pulled out from the apparatus body, the second arm portion extending in a direction that intersects the rotational axis and having a second connected portion pivotally connected with the second supporting member;

a second urging member configured to urge the second supporting member or the moving mechanism such that a rotation moment in the first direction around the rotational axis is applied to the second arm portion in the state where the opening/closing member is in the open position; and a shaft portion which is rotatable about the rotational axis and extending in a direction of the rotational axis, and to which the first arm portion and the second arm portion are fixed such that the first arm portion and the second arm portion are arranged in the direction of the rotational axis.

9. The image forming apparatus according to claim 1, wherein the opening/closing member is configured to rotate about the rotational axis between the open position and the closed position.

10. The image forming apparatus according to claim 1, wherein the moving mechanism includes a shaft portion rotatable about the rotational axis and to which the arm portion is fixed, and wherein the opening/closing member includes a linked portion by which the opening/closing member is linked to the shaft portion.

11. The image forming apparatus according to claim 10, wherein the urging member is attached to the supporting member, and wherein in the state where the opening/closing member is in the open position, an urging force of the urging member is applied to the linked portion via the shaft portion and the arm portion.

12. The image forming apparatus according to claim 1, wherein the opening/closing member has a guide portion configured to guide the cartridge toward the supporting member when the opening/closing member is in the open position, the guide portion being provided on an upwardly facing surface of the opening/closing member in the state where the opening/closing member is in the open position.

* * * * *